US012029316B2

(12) United States Patent
Herman

(10) Patent No.: US 12,029,316 B2
(45) Date of Patent: Jul. 9, 2024

(54) PLATFORM HAVING ADJUSTABLY POSITIONABLE IMMOBILIZERS

(71) Applicant: Benjamin Jay Herman, Longmont, CO (US)

(72) Inventor: Benjamin Jay Herman, Longmont, CO (US)

( * ) Notice: Subject to any disclaimer, the term of this patent is extended or adjusted under 35 U.S.C. 154(b) by 0 days.

(21) Appl. No.: 17/476,472

(22) Filed: Sep. 15, 2021

(65) Prior Publication Data

US 2022/0202183 A1 Jun. 30, 2022

Related U.S. Application Data

(60) Provisional application No. 63/130,515, filed on Dec. 24, 2020.

(51) Int. Cl.

| | |
|---|---|
| ***A47B 96/18*** | (2006.01) |
| ***A47B 37/00*** | (2006.01) |
| ***A47G 23/06*** | (2006.01) |
| ***A47G 29/00*** | (2006.01) |
| *A47G 19/10* | (2006.01) |
| *B63B 29/08* | (2006.01) |

(52) U.S. Cl.

CPC ..... *A47B 96/18* (2013.01); *A47B 37/00* (2013.01); *A47G 23/06* (2013.01); *A47G 29/00* (2013.01); *A47G 19/10* (2013.01); *B63B 29/08* (2013.01)

(58) Field of Classification Search

CPC ..... A47B 96/18; A47B 37/00; A47B 96/021; A47B 13/16; A47B 88/981; A47G 23/06; A47G 29/00; A47G 19/10; B63B 29/08

See application file for complete search history.

(56) References Cited

U.S. PATENT DOCUMENTS

| | | | | |
|---|---|---|---|---|
| 589,607 | A * | 9/1897 | Mills | E21B 31/18 294/86.24 |
| 630,734 | A | 8/1899 | Oothout | |
| 1,762,805 | A | 6/1930 | Tucker | |
| 1,824,344 | A | 9/1931 | Goldberg | |

(Continued)

FOREIGN PATENT DOCUMENTS

| | | | |
|---|---|---|---|
| CN | 110313730 | A | 10/2019 |
| ES | 2700856 | | 2/2019 |
| JP | 2004092713 | A | 3/2004 |

OTHER PUBLICATIONS

International Search Report dated Mar. 24, 2022 for PCT/US2021/065022.

(Continued)

*Primary Examiner* — Ko H Chan

(57) ABSTRACT

A platform having a plurality of specialized openings shaped to accept specialized pegs to act as immobilizers for objects to be placed on the platform. The pegs have a shaft and at least one pair of nubs protruding from the shaft of each peg. The openings are shaped to allow the first end of the shaft to pass therethrough but not the nubs unless the peg is positioned so that the nubs are aligned with a notched portion of the opening, and the head at the second end stops further movement of the peg through the opening. When the nubs do not pass through the opening, the nubs act as a pivot axis where a portion of the peg remains above the platform. Pegs so adjustably positioned in the openings can be arranged to surround and immobilize an object on the platform.

16 Claims, 33 Drawing Sheets

(56) References Cited

U.S. PATENT DOCUMENTS 2,599,207 A 3/1952 Spahr
3,080,203 A 3/1963 Graham
3,561,516 A * 2/1971 Reddy ..... F16B 41/002 411/347
4,535,487 A * 8/1985 Esper ..... A61F 2/36 606/62
4,763,412 A * 8/1988 Basavanhally ..... H05K 13/04 29/564.6
4,793,603 A * 12/1988 Wober ..... B25B 5/04 269/254 R
4,798,292 A * 1/1989 Hauze ..... A61L 2/26 206/439
4,840,523 A 6/1989 Oshida
4,860,627 A * 8/1989 Sloane ..... G10D 3/14 984/119
5,174,675 A * 12/1992 Martin ..... F16B 5/0225 187/334
5,319,161 A 6/1994 Jolidon
D383,607 S 9/1997 Whitlock
5,758,598 A 6/1998 Rothert
6,142,323 A 11/2000 Veil
6,213,918 B1 * 4/2001 Rogers, Jr. ..... A63B 23/16 601/40
6,375,134 B1 4/2002 Goldschmidt
6,668,695 B2 * 12/2003 Poole ..... B25B 5/08 83/762
6,769,538 B2 8/2004 Oswald
6,872,039 B2 * 3/2005 Baus ..... F16B 21/125 411/347
7,086,643 B2 * 8/2006 Teague ..... B25B 5/06 269/305
7,150,362 B1 * 12/2006 Questiaux ..... B25H 3/04 211/183
7,175,024 B2 * 2/2007 Fankhauser ..... H01L 21/67346 411/509
7,601,312 B2 * 10/2009 Riley ..... A61B 50/33 248/684
7,966,949 B2 * 6/2011 Willey ..... B60N 3/002 108/44
8,096,514 B1 1/2012 Stocker
8,371,444 B1 * 2/2013 Huang ..... B25H 3/003 206/374
8,459,472 B2 * 6/2013 Hofman ..... A47F 5/0815 211/106.01
8,522,986 B2 * 9/2013 Kitchen ..... B25H 3/04 248/220.31
9,024,188 B2 * 5/2015 Lacey, Jr. ..... H02G 3/0608 174/68.3
9,457,443 B2 * 10/2016 Miller ..... B23C 9/00
9,581,782 B2 * 2/2017 Abby ..... H04Q 1/064
10,266,305 B2 4/2019 Lee
10,918,192 B1 * 2/2021 Wilmot ..... A45D 44/14
11,076,709 B2 * 8/2021 Gillespie ..... F16B 5/0056
11,542,977 B2 * 1/2023 Baus ..... F16B 19/109
2002/0023855 A1 2/2002 Cho
2004/0089662 A1 5/2004 Smith
2005/0073081 A1 * 4/2005 Teague ..... B25B 5/006 269/305
2007/0262038 A1 11/2007 Harbison
2008/0223801 A1 * 9/2008 Krempa ..... A47J 47/16 211/71.01
2009/0041910 A1 2/2009 Rabinovitch
2015/0073321 A1 * 3/2015 Taylor ..... A61H 15/0092 601/118
2017/0259405 A1 * 9/2017 Lin ..... B23Q 3/066
2018/0087554 A1 * 3/2018 Dreher ..... F16B 21/12
2018/0339808 A1 11/2018 Palmquist

OTHER PUBLICATIONS

International Preliminary Report on Patentability dated Jul. 13, 2023 for PCT/US2021/065022.

Chenyakhovskaya, Peg-On-Hole: Fundamental Principles of Motion of a Peg Leaning on a Horizontal Hole Edge, Advances in Science and Technology Research Journal, vol. 11, Issue 4, Dec. 2017, pp. 49-59.

Webpage at https://www.umbra.com/products/peggy-drawer-organizer, printed on Jan. 12, 2021.

* cited by examiner

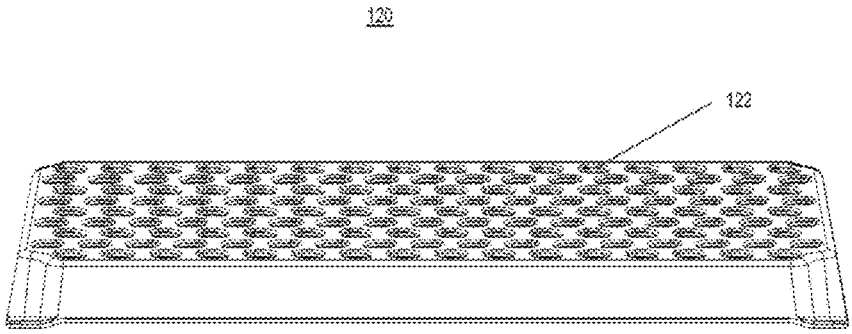
FIGURE 49
FIGURE 50
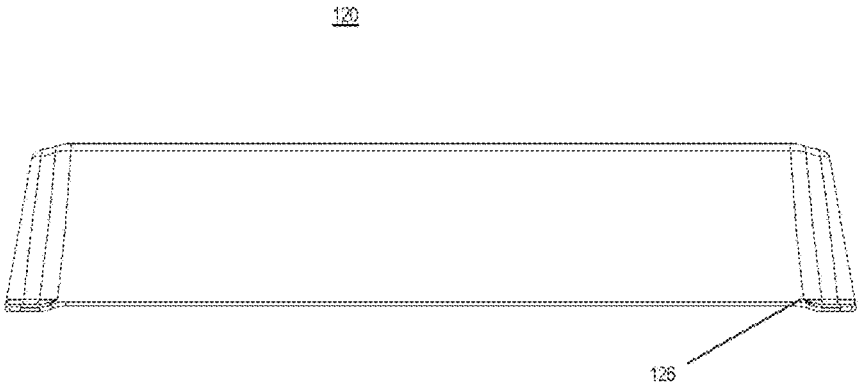
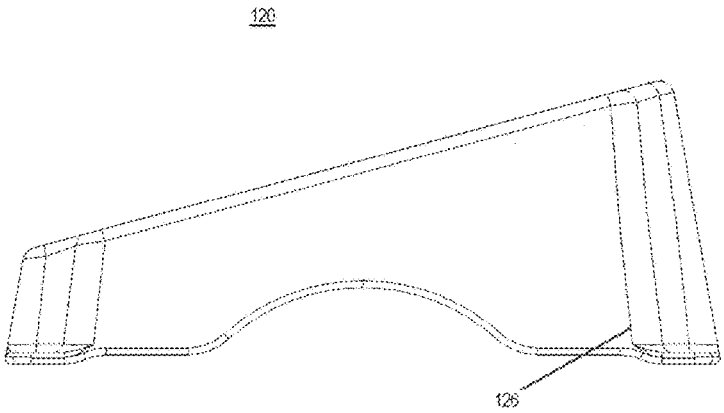
FIGURE 51

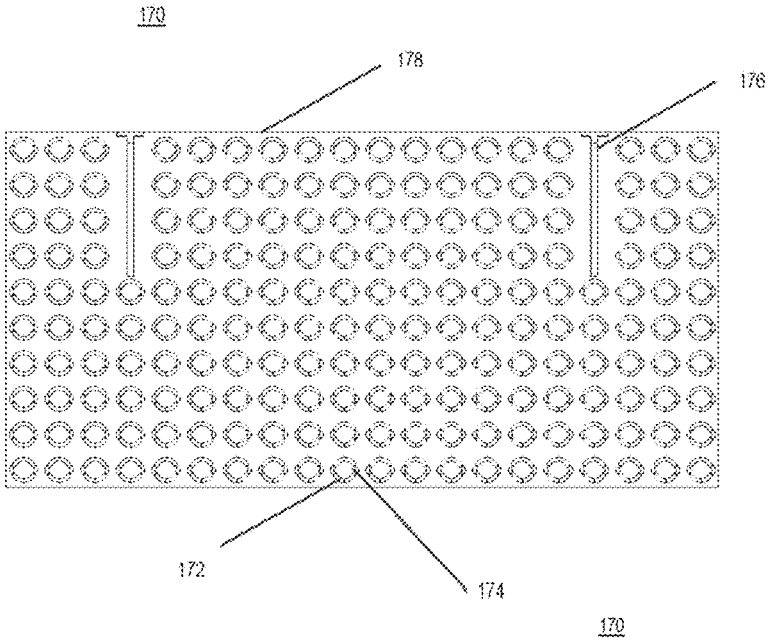
FIGURE 72
FIGURE 73
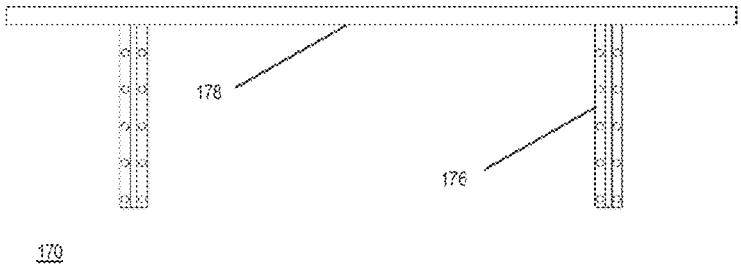
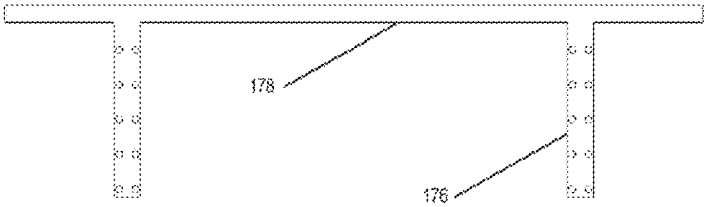
FIGURE 74
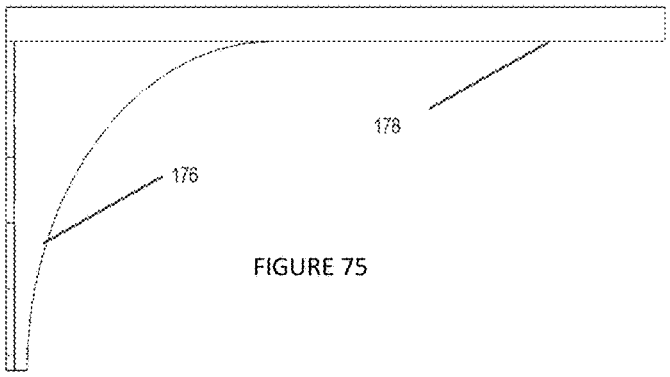
FIGURE 75

PLATFORM HAVING ADJUSTABLY POSITIONABLE IMMOBILIZERS

The present application claims the benefit of Provisional Patent Application No. 63/130,515, filed Dec. 24, 2020, entitled "Object Immobilizer," by Benjamin Jay Herman. The disclosure of this Provisional Patent Application is incorporated by reference herein in its entirety.

FIELD OF THE INVENTION

The present invention relates to methods and devices for a platform having adjustable immobilizers for objects placed on the platform.

BACKGROUND

The following description includes information that may be useful in understanding the present invention. It is not an admission that any of the information provided herein is prior art or relevant to the presently claimed invention, or that any publication specifically or implicitly referenced is prior art.

For sailors eating a meal aboard a ship while at sea, dowels were inserted straight into holes on a tabletop such that food bowls or plates were held stationary by the dowels that surrounded the bowl. The dowels were not designed to have different effective heights, or to allow for angular movement, when inserted into the holes.

Holders for containers including a base and retaining rods extending upwardly from the base at spaced apart locations to define a container retention space bounded by the retaining rods for holding the containers. For example, the base may have positioning recesses for three retaining rods spaced apart arcuately a distance of one hundred twenty degrees centered on an outer concentric circle, with a second set of positioning recesses is provided in the base, also spaced apart arcuately a distance of one hundred twenty degrees and centered on an inner concentric circle. The plurality of sets of three arcuately spaced positioning recesses makes it possible to use the holder for containers and covers of different size diameters. The three retaining rods are manually removable, and can be seated in positioning recesses centered on a large diameter circle for holding and stacking a collection of empty containers having a large diameter, and in those centered on a small diameter circle for collection of empty containers having a small diameter.

The present invention addresses these limitations by providing for a novel method and device for adjustably immobilizing objects on a platform.

SUMMARY OF THE INVENTION

The present invention provides methods and devices for a raised platform having adjustably positioned immobilizers.

In one embodiment, the apparatus comprises a platform having a top, a bottom, and a plurality of openings from the top through the bottom; a plurality of pegs, wherein each peg includes a first end, a second end, a shaft having a length between the first end and the second end, and at least one pair of nubs protruding from the shaft of each peg; wherein each of the openings are shaped to allow the first end of the shaft to pass therethrough but not the pair of nubs unless the peg is positioned so that the nubs are aligned with a notched portion of the opening, and when the nubs do not pass through the opening, the nubs act as a pivot axis where a portion of the peg remains above the platform such that the portions of the pegs above the platform define a confine for immobilizing an object on the platform.

In another embodiment, a peg apparatus comprises a first end, a second end, and a shaft having a length between the first end and the second end, and at least one pair of nubs protruding from the shaft of each peg.

In yet another embodiment, a method of immobilizing an object on a platform, comprises the steps of: placing a plurality of pegs in a platform having a top, a bottom, and a plurality of openings from the top through the bottom, wherein each peg includes a first end, a second end, and a shaft having a length between the first end and the second end, and at least one pair of nubs protruding from the shaft of each peg, such each of the openings are shaped to allow the first end of the shaft to pass therethrough but not the pair of nubs unless the peg is positioned so that the nubs are aligned with a notched portion of the opening; and when the nubs do not pass through the opening, the nubs act as a pivot axis where a portion of the peg remains above the platform; positioning each of the pegs of the plurality of pegs in an opening where so that the nub of at least one of the pegs does not pass through the opening where a portion of the peg remains above the platform such that the portions of the pegs above the platform define a confine for immobilizing an object on the platform; and setting an object on the top of the platform wherein the object is immobilized by the plurality of pegs placed in the platform.

Other features and advantages of the present invention will become more apparent from the following detailed description of the invention, when taken in conjunction with the accompanying exemplary drawings.

BRIEF DESCRIPTION OF THE DRAWINGS

FIG. 49 is a front elevation view of the platform.

FIG. 50 is a rear elevation view of the platform.

FIG. 51 is a side elevation view of the platform.

FIG. 72 is a bottom plan view of the platform.

FIG. 73 is a front elevation view of the platform.

FIG. 74 is a rear elevation view of the platform.

FIG. 75 is a side elevation view of the platform.

DETAILED DESCRIPTION OF EMBODIMENTS

Figure 1:
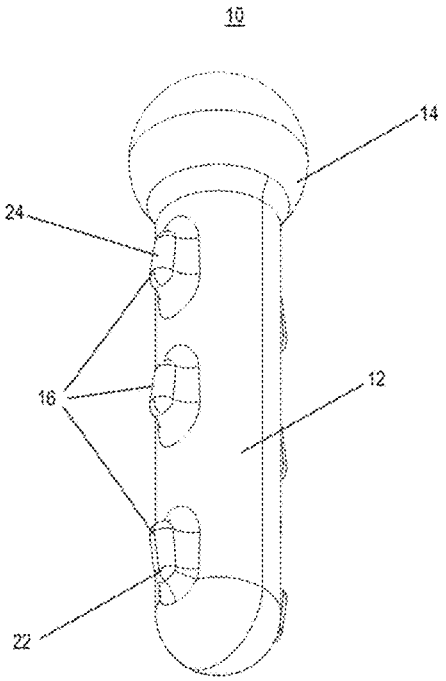
FIG. 1 depicts a perspective view of a peg in accordance with an embodiment of the present invention.
Figure 2:
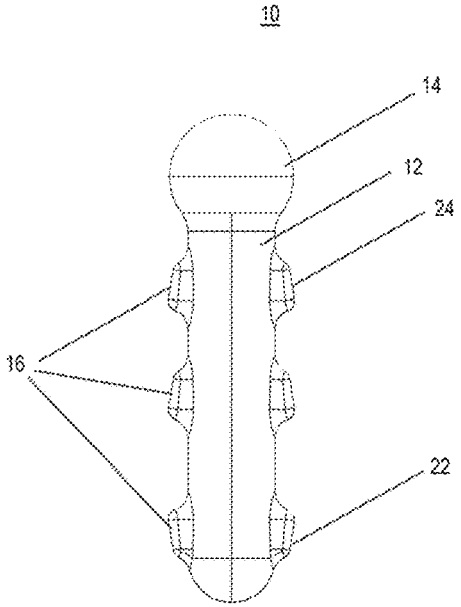
FIG. 2 is a front elevation view of the peg.
Figure 4:
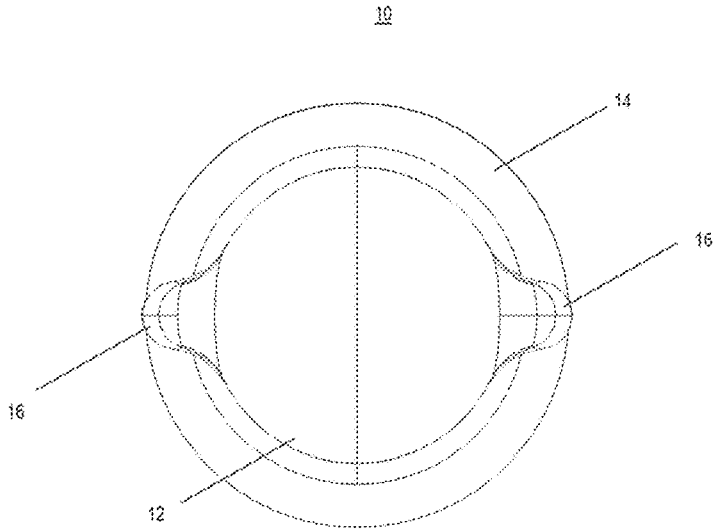
FIG. 4 is a bottom plan view of the peg.
Figure 3:
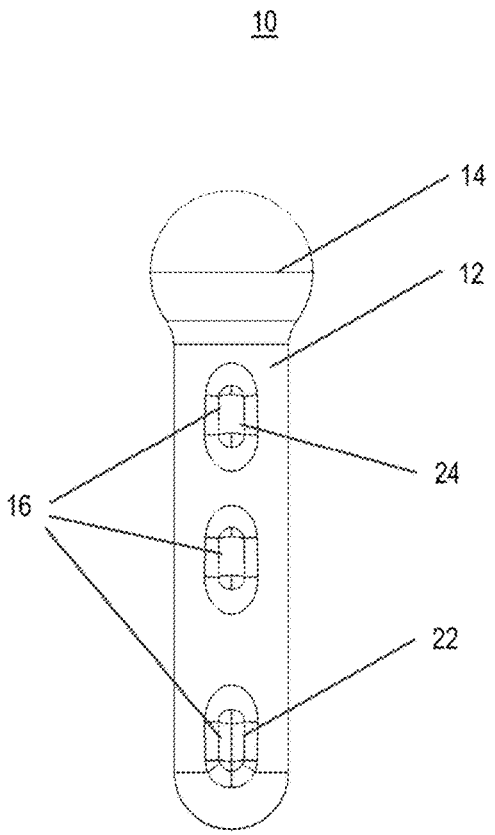
FIG. 3 is a side elevation view of the peg.
Figure 5A:
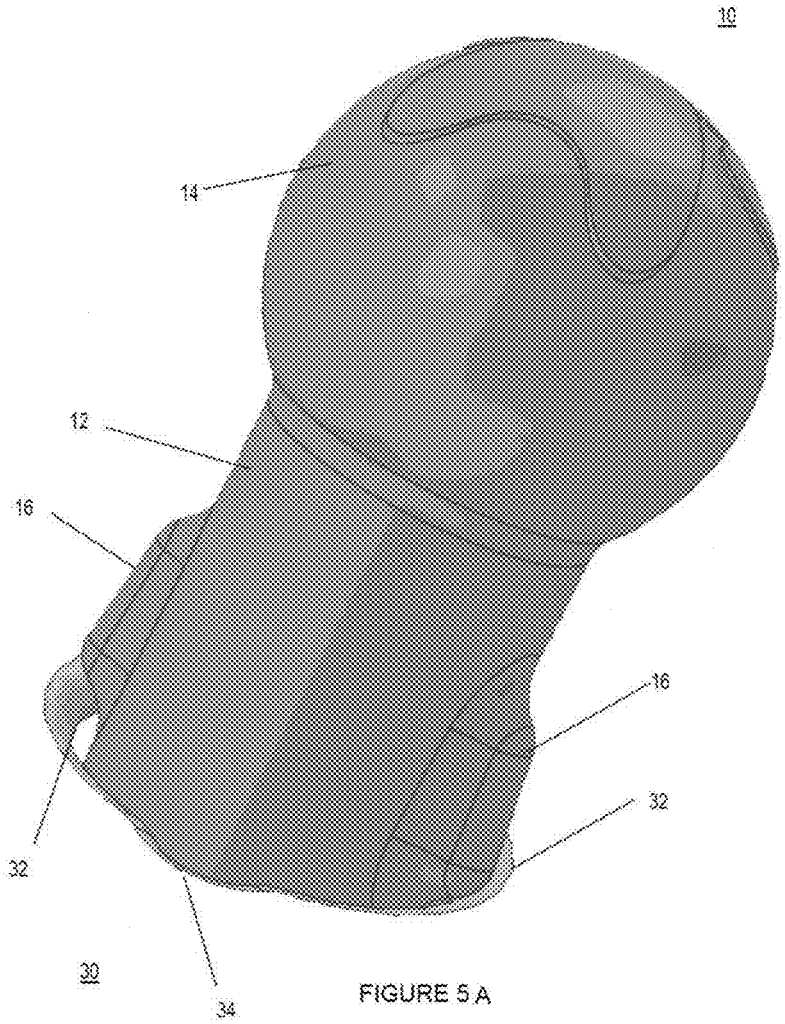
FIG. 5 is a perspective view of a platform in accordance with an embodiment of the present invention.
Figure 5B:
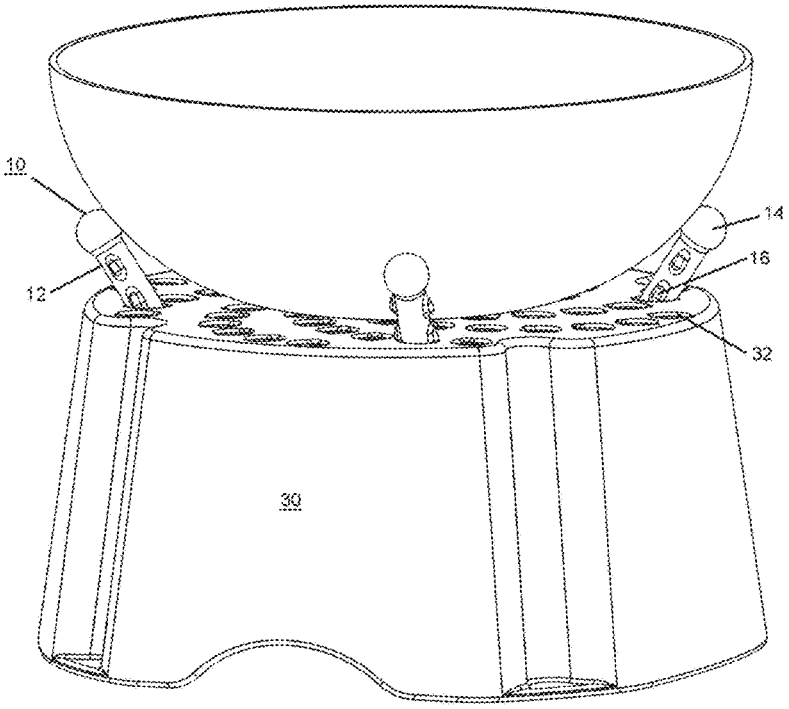
Figure 6:
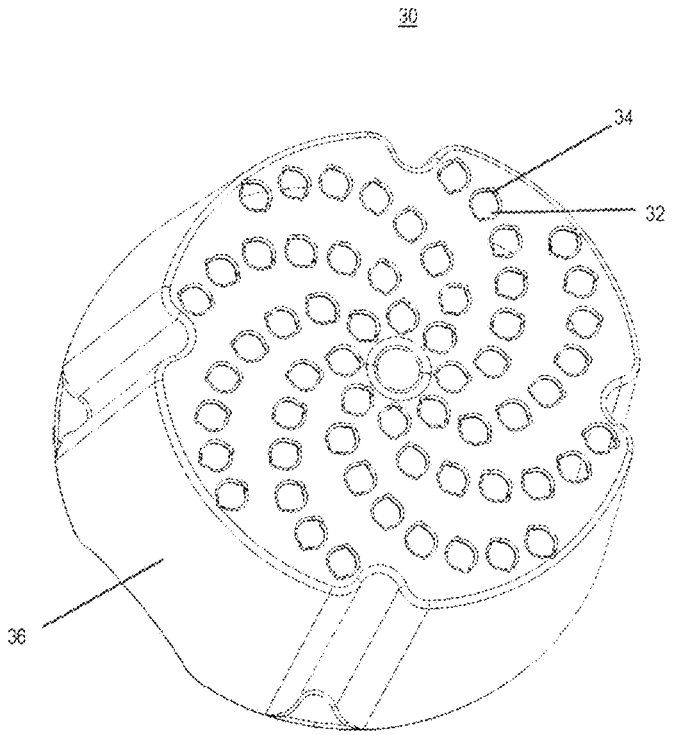
FIG. 6 is a top view of the platform.
Figure 7:
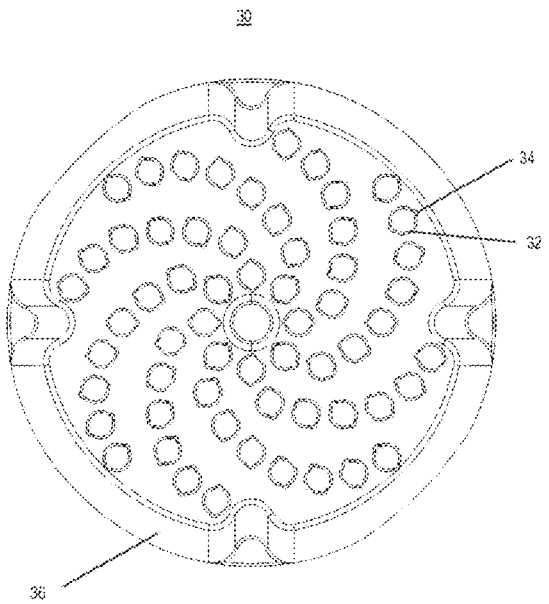
FIG. 7 is a bottom perspective view of the platform.
Figure 8:
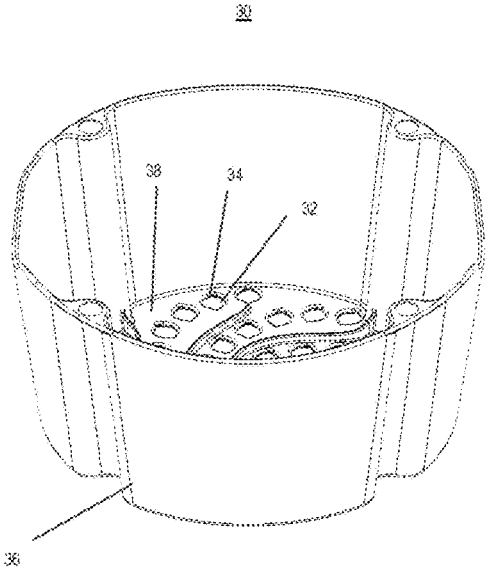
FIG. 8 is an bottom plan view of the platform.
Figure 9:
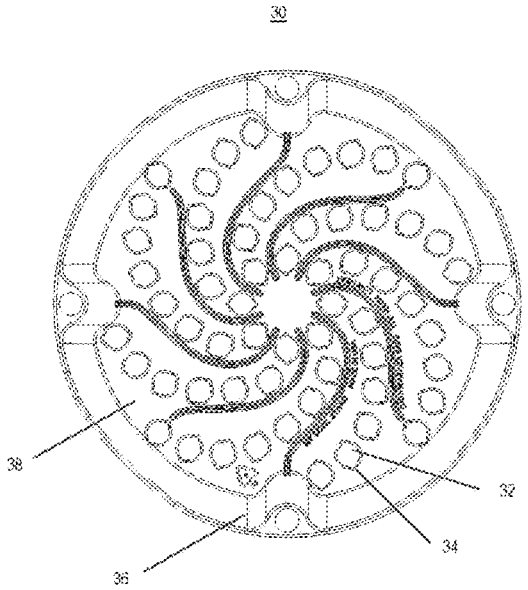
FIG. 9 is a side view of the platform.

In various embodiments, the platform has a plurality of specialized openings shaped to accept specialized pegs to act as adjustable immobilizers for objects to be placed on the platform, where the pegs positioned in openings act to immobilize the object on the platform. Referring now to the drawings, like parts are designated by like reference characters throughout the several views.

The immobilizer is a device for securing a vessel, container, or other object, in place or on a surface to prevent it from becoming dislodged from the surface or falling or sliding off of the surface. In one embodiment, the immobilizer includes a surface capable of receiving at least one peg element in at least one location opening or slot. The surface may include a plurality of slots for receiving the peg elements to produce different configurations. A slot may have a complimenting shape with respect to the cross-sectional shape of a peg element.

As illustrated in FIGS. 1 through 4, one embodiment of the peg 10 includes a shaft 12 having two ends with an enlarged head 14 at the upper end. The peg 10 includes multiple pairs of trapezoidal nubs 16, where one side of the nubs has a shorter side than the opposite side along the length of the shaft 12. The asymmetrical shape of the trapezoidal nubs may have different orientations depending on where the nubs are located along the shaft. For example, the lower nubs 22 near the bottom of the peg may be orientated so that the shorter side of the nub is facing the lower end of the shaft 12. This lower orientation facilitates passage of the nubs through the complementary opening or slot in the platform which will be discussed later. The upper nubs 24 near the end of the shaft 12 with the head 14 may be orientated so that the shorter side of the nub is facing the head of the shaft 12, and the longer side of the of the nub is facing the lower end of the shaft. This upper orientation does not facilitate passage of the nubs through the complementary opening or slot in the platform in the same direction as the lower orientation. The upper orientation facilitates passage of the nubs through the keyed opening or slot in the platform in the opposite direction as the lower orientation. Where there are additional nubs between the lower nubs 22 and the upper nubs 24, those intermediate nubs may have the same or different orientations as the designer sees fit. In FIGS. 1 through 4, the intermediate nubs are shown as having the same orientation as the upper nubs 24, but other orientations and designs may be used if desired.

The nubs may be angled to make passage through the keyed surface hole easier in one direction, and more difficult in the other. The direction of nub angles can vary from pair to pair. Nubs may also be without angle to create equal passage difficulty in both directions.

As illustrated in FIGS. 5 through 9, one embodiment of a platform 30 for accepting the peg 10 includes openings or slots 32 configured with notches 34 or other keyed shapes complementary to the nubs 16 of the peg 10. The sidewalls 36 of the platform 30 sets the openings or slots 32 to occupy a raised position. Preferably the area bounded by the area below the bottom surface 38 and the sidewalls 36 is hollow to allow the lower portion of the peg 10 to move or pivot.

The diameter of the shaft 12 of the peg 10 is undersized relative to the main diameter of the holes in the surface of the platform 30. This allows for angular movement when the peg 10 is inserted into one of the holes 32. Maximum angle is when one side of the peg 10 is resting on the top edge of the hole 32, and the other side of the peg 10 on the bottom edge of the hole 32.

Figure 10:
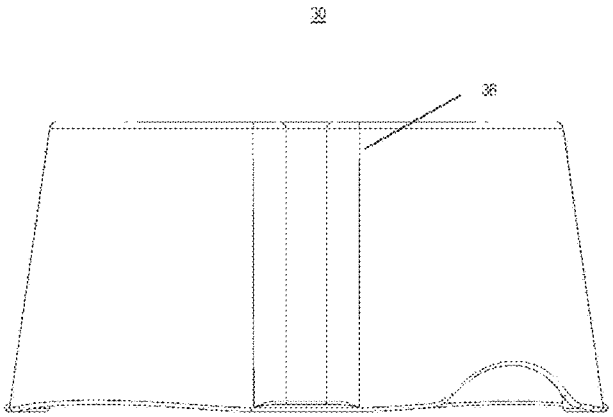
FIG. 10 is a perspective view of the peg inserted into a complementary opening in a platform surface.
Figure 11:
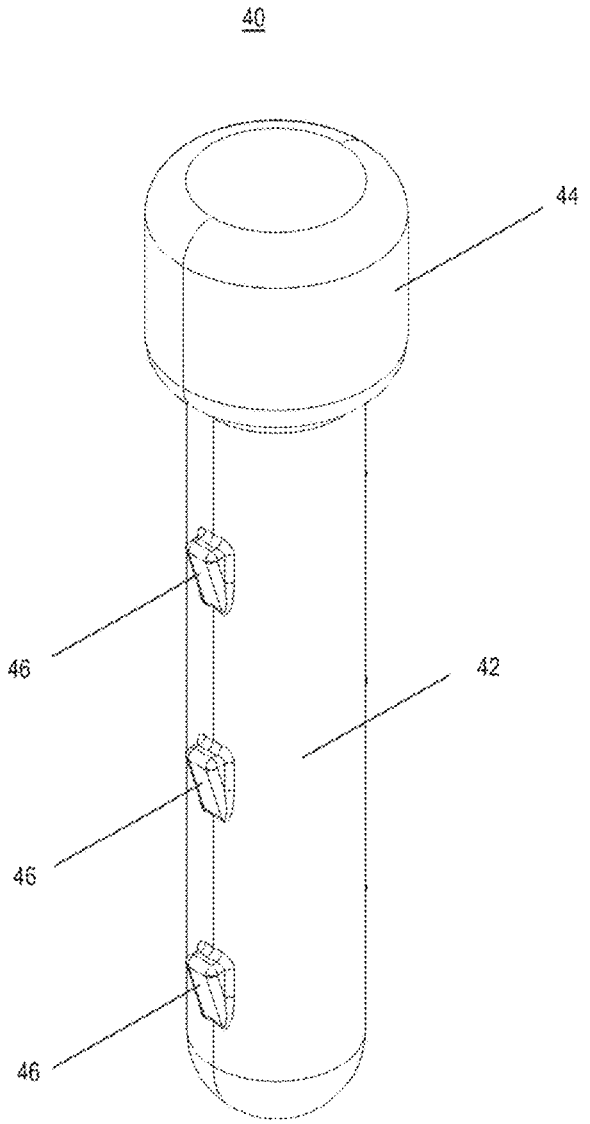
FIG. 11 is a perspective view of another peg having triangular nubs in accordance with another embodiment of the present invention.
Figure 12:
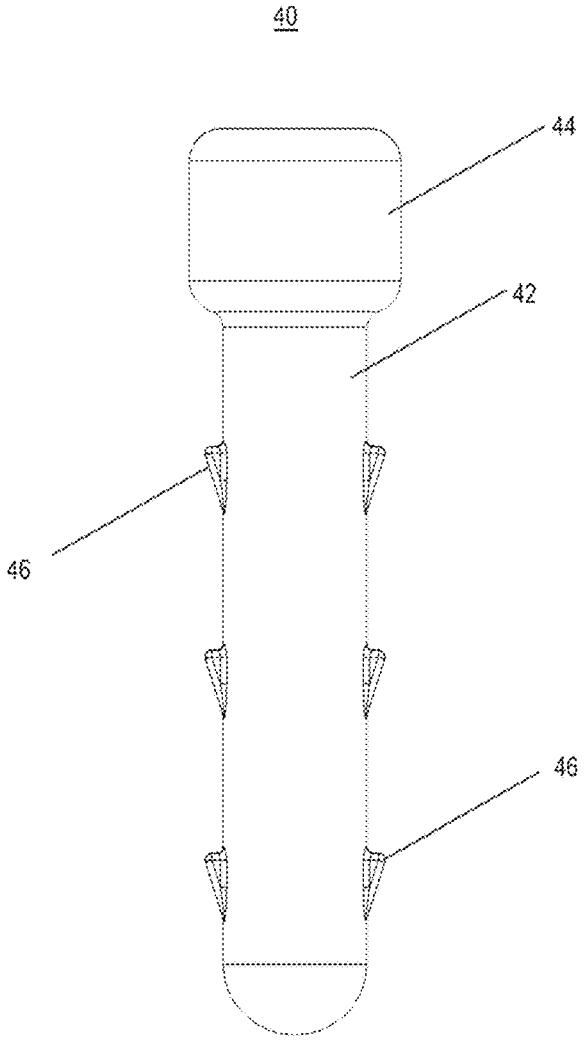
FIG. 12 is a front elevation view of the peg.
Figure 13:
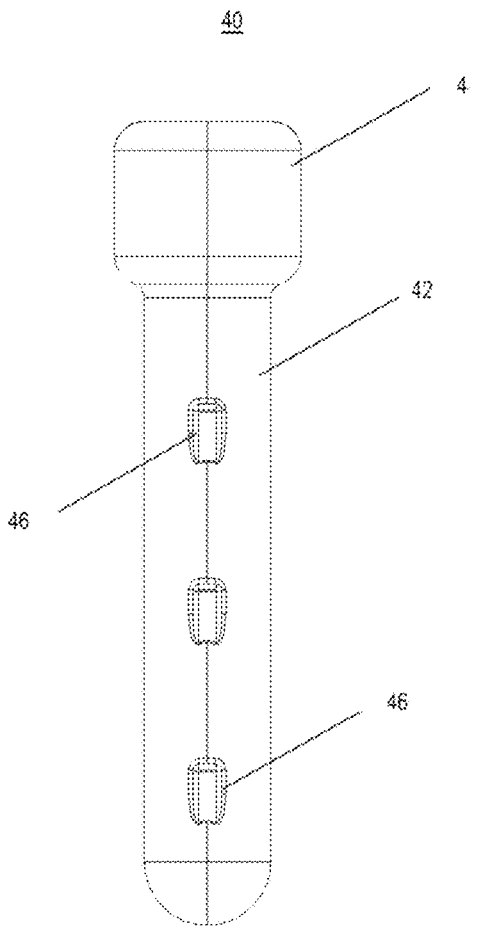
FIG. 13 is a side elevation view of the peg.
Figure 14:
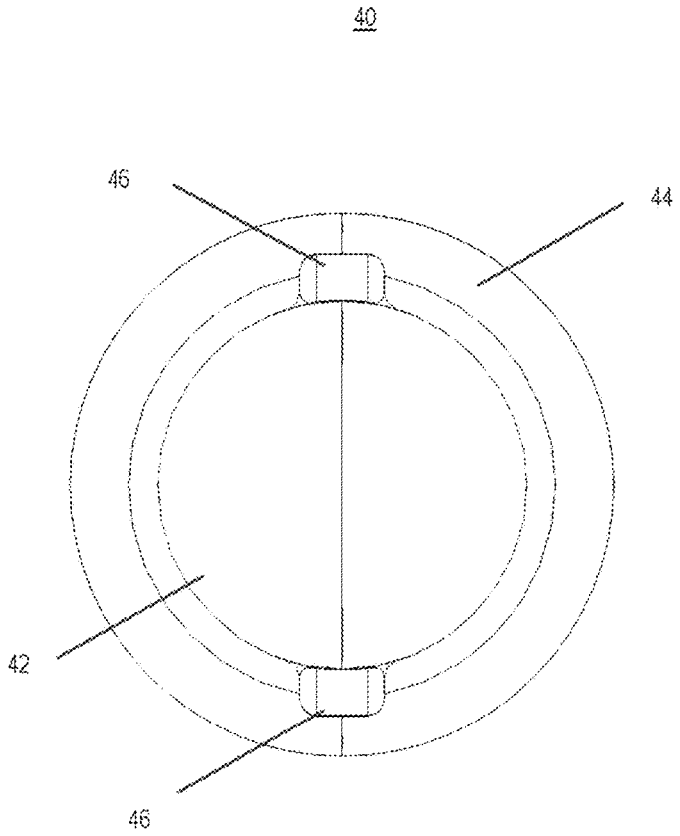
FIG. 14 is a bottom plan view of the peg.
Figure 15:
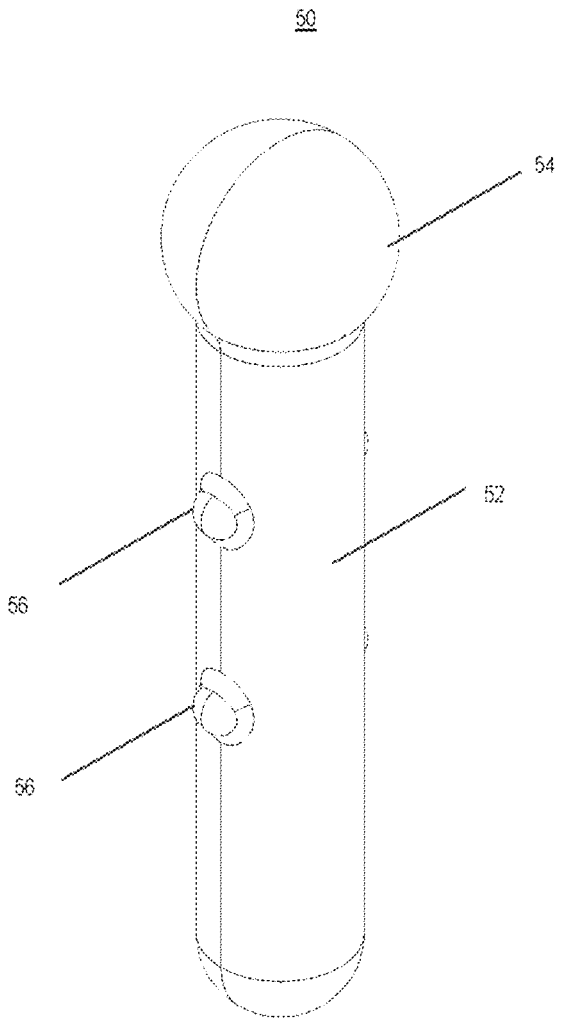
FIG. 15 is a perspective view of another peg having circular nubs in accordance with another embodiment of the present invention.
Figure 16:
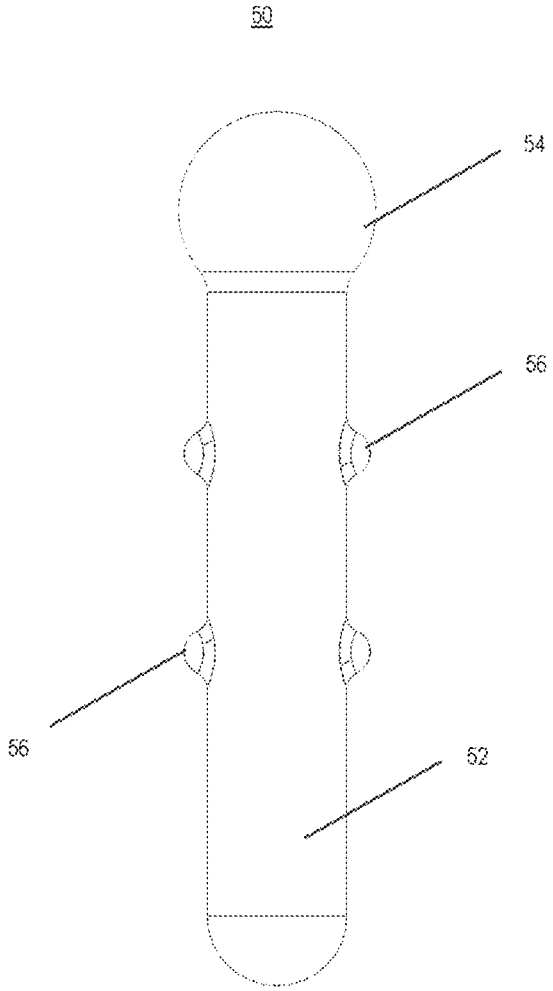
FIG. 16 is a front elevation view of the peg.
Figure 17:
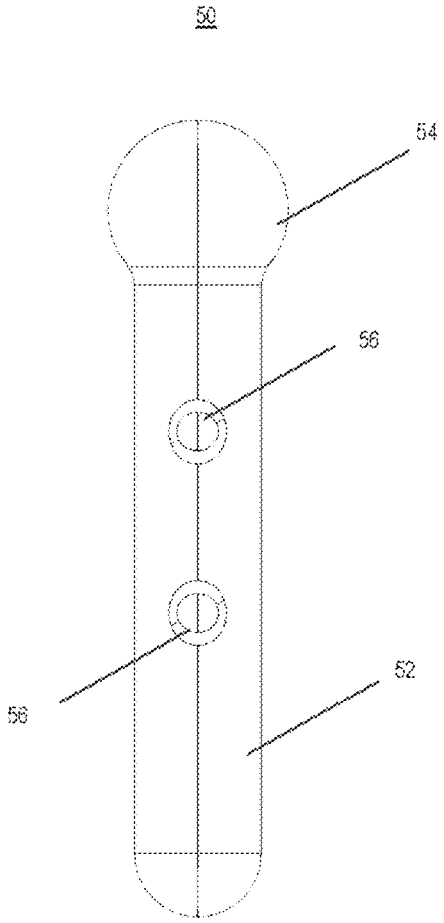
FIG. 17 is a side elevation view of the peg.
Figure 18:
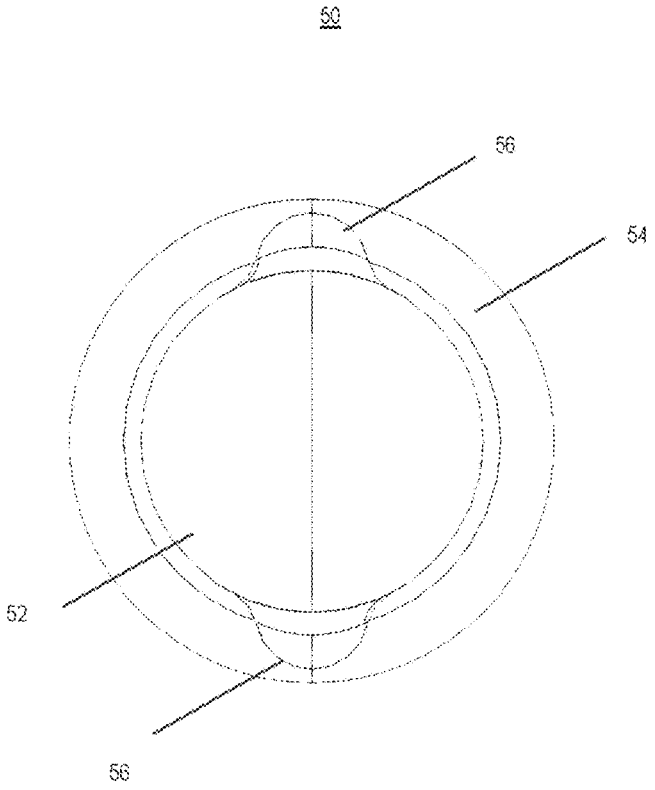
FIG. 18 is a bottom plan view of the peg.
Figure 19:
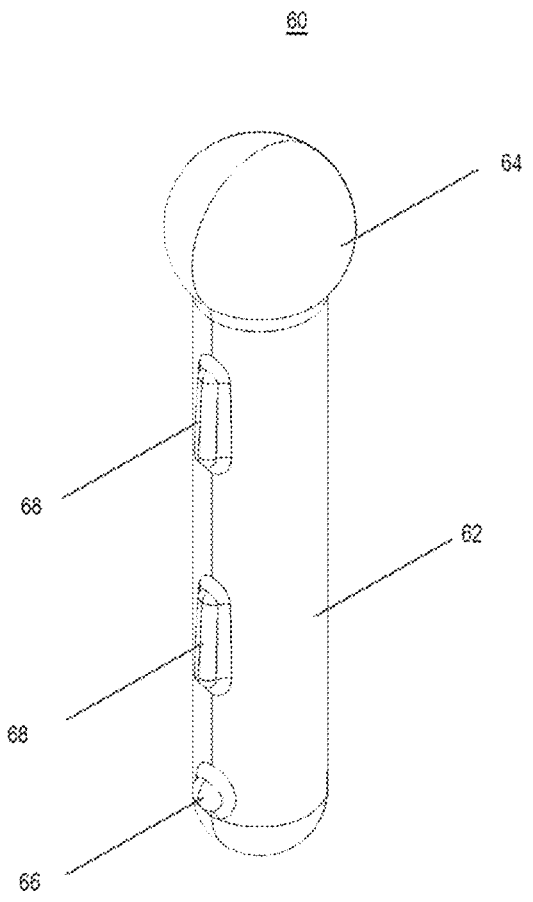
FIG. 19 is a perspective view of another peg having different pairs of nubs in accordance with another embodiment of the present invention.
Figure 20:
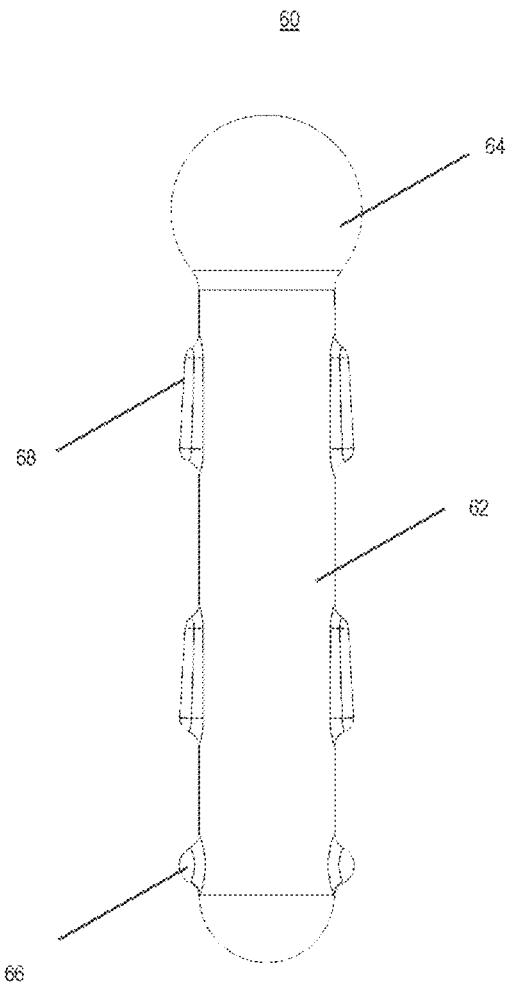
FIG. 20 is a front elevation view of the peg.
Figure 21:
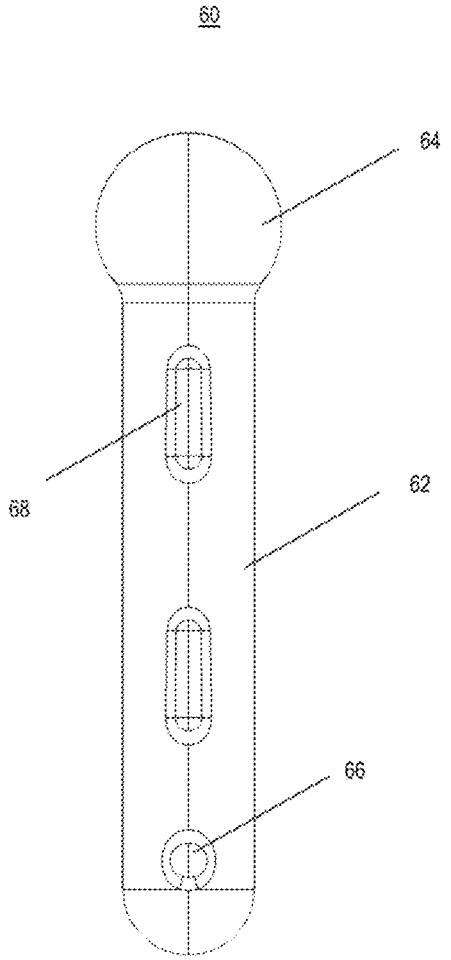
FIG. 21 is a side elevation view of the peg.

The nubs 16 of the peg 10, when aligned with the keyed portions 34 of the surface holes 32 of the platform 30, allow the pegs 10 to pass through. When not aligned, the span distance across the ends of the nubs is larger than the diameter of the main surface hole, preventing passage. As illustrated in FIG. 10, when the lower nubs are passed through the keyed slot 32, the peg 10 may be turned or rotated so that the upper nubs are not aligned with the keyed notches 34 so the remaining nubs 16 contact the side of the slot 32 and not the keyed notches 34, which will block further movement of the peg 10 through the slot 32. By this misalignment, the nubs of the peg 10 act as a pivot axis for the peg to change angle, and also serve to increase the effective height of the peg head 14 above the surface of the platform 30. If all of the nubs are passed through the keyed openings, then the enlarged head 14 of the peg can prevent further passage.

To immobilize an object (not shown) on a platform, a plurality of pegs 10 and inserted into the openings 32 on the platform 30 the first end of the peg shaft 12 to pass therethrough but not the pair of nubs 16 unless the peg is oriented such that the nubs are aligned with a notched portion of the opening 32. When the nubs 16 do not pass through the opening 32, the nubs 16 act as a pivot axis where a portion of the peg 10 remains above the platform. Each of the plurality of pegs 10 are set into a selected opening 32 so that configuration of pegs 10 inserted into the platform 30 define a confine or boundary for holding or immobilizing an object on the platform. The confine or boundary may be circular, rectangular, or irregularly shaped to conform to the periphery of the object so as to hold or immobilize the object on the platform. The object set on the platform is immobilized by the plurality of pegs placed in select slots in or around the object to thereby immobilize and secure the object on the platform in a customizable or adjustable manner.

As illustrated in FIGS. 11 through 14, another embodiment of the peg 40 includes a shaft 42 having two ends with an enlarged cylindrical head 44 at the upper end. The peg 40 includes multiple pairs of triangular nubs 46 where the hypotenuse and longer leg of the triangular nub aligns with the longitudinal axis of the peg, and the shorter leg is orthogonal to the longitudinal axis of the peg. The lower nubs near the bottom of the peg may be orientated so that the shorter leg of the triangular nub is facing opposite to the lower end of the shaft 42. This lower orientation facilitates passage of the nubs through the complementary opening or slot in the platform. In this embodiment, all of the nubs share the same orientation, but other orientations and designs may be used if desired. For example, alternatively, the triangular nub may be spring-loaded so they can be pushed into the shaft which can facilitate pushing the peg down through the platform openings, while still preventing the peg from traversing in the opposite direction unless properly oriented to correspond with the keyed opening.

As illustrated in FIGS. 15 through 18, another embodiment of the peg 50 includes a shaft 52 having two ends with an enlarged circular head 54 at the upper end. The peg 50 includes multiple pairs of circular nubs 56. The circular nubs may be fixed on the shaft. In the alternative, the circular nubs may be pushed into the shaft which can facilitate pushing the peg down through the platform openings.

Figure 22:
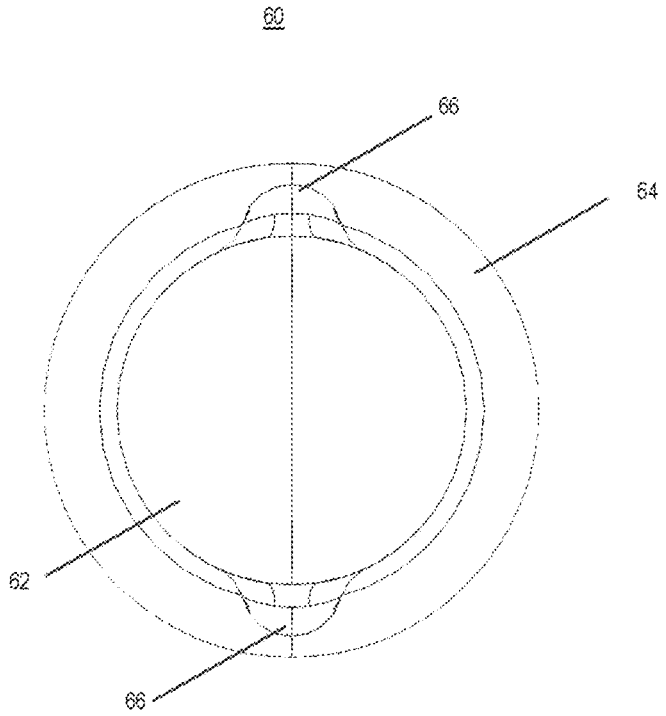
FIG. 22 is a bottom plan view of the peg.
Figure 23:
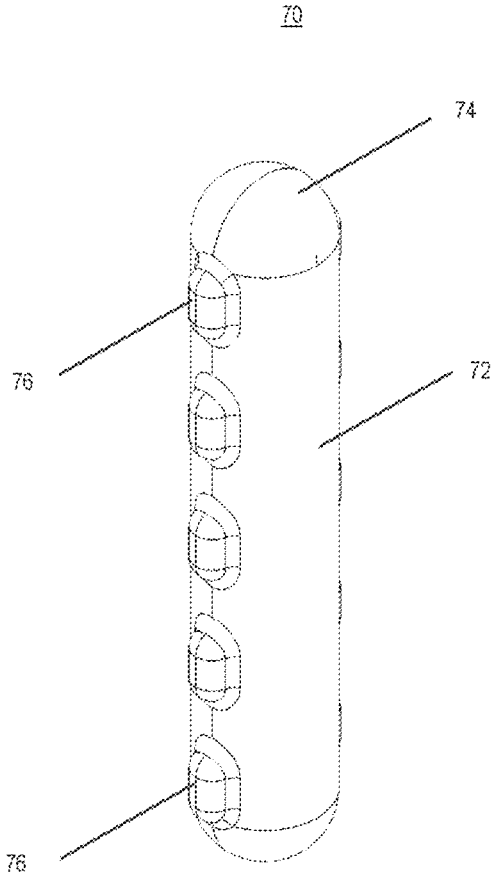
FIG. 23 is a perspective view of a headless peg having multiple nubs in accordance with another embodiment of the present invention.
Figure 24:
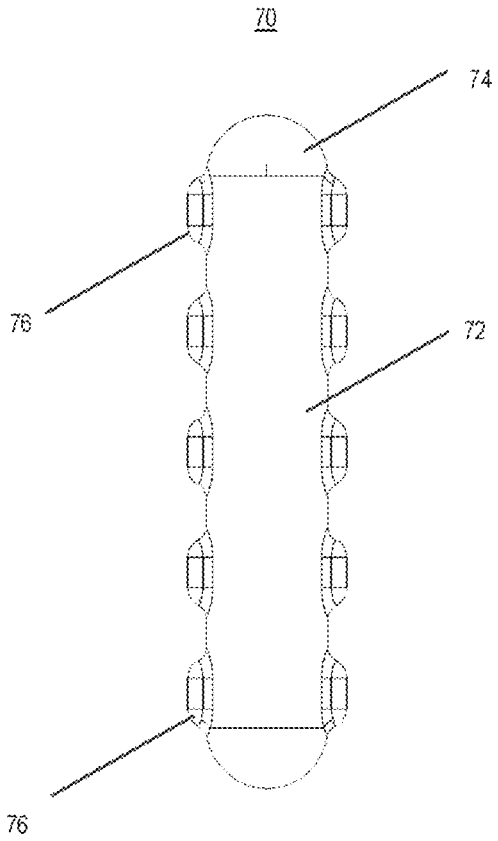
FIG. 24 is a front elevation view of the peg.
Figure 25:
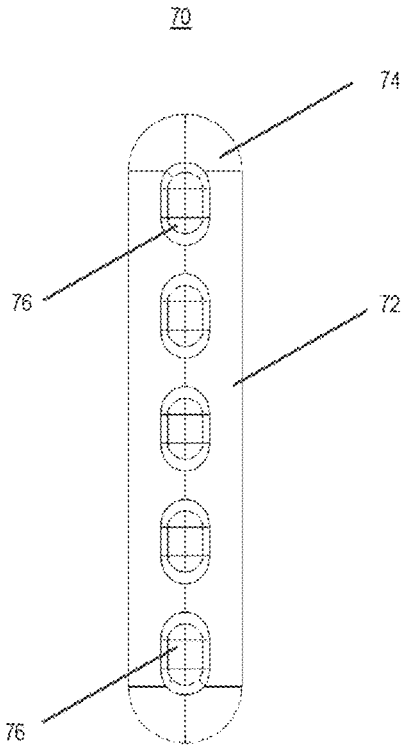
FIG. 25 is a side elevation view of the peg.
Figure 26:
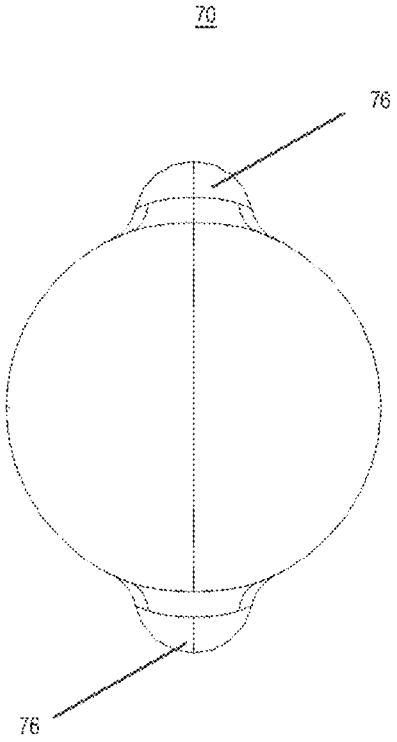
FIG. 26 is a bottom plan view of the peg.
Figure 27:
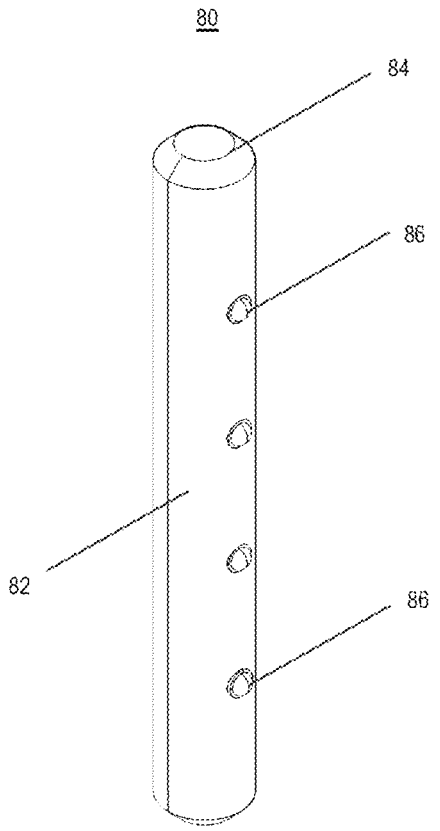
FIG. 27 is a perspective view of a headless peg having spring-loaded nubs in accordance with another embodiment of the present invention.
Figure 28:
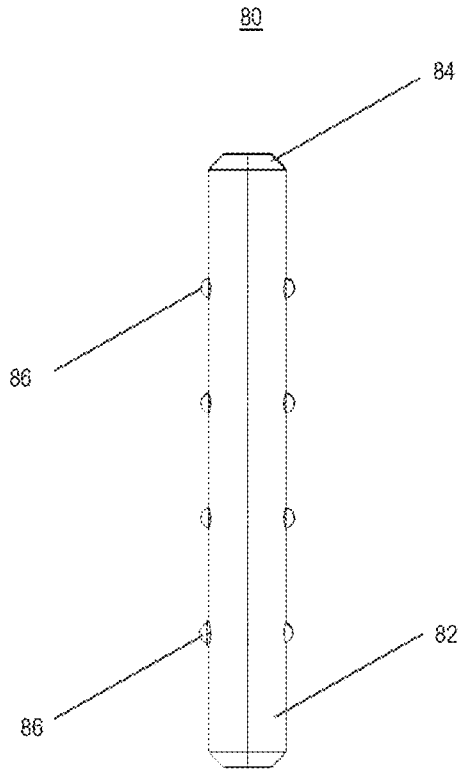
FIG. 28 is a front elevation view of the peg.
Figure 29:
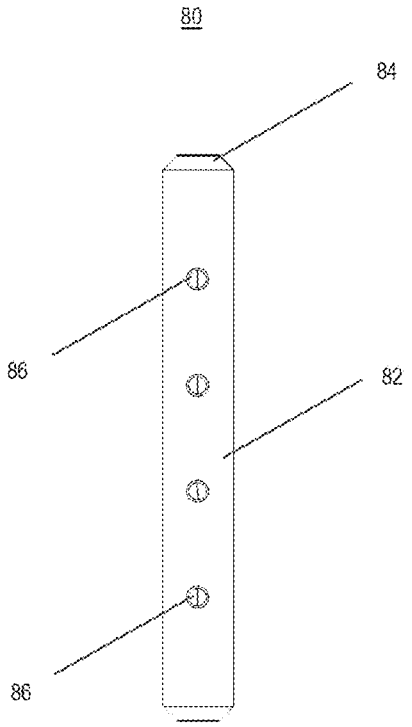
FIG. 29 is a side elevation view of the peg.
Figure 30:
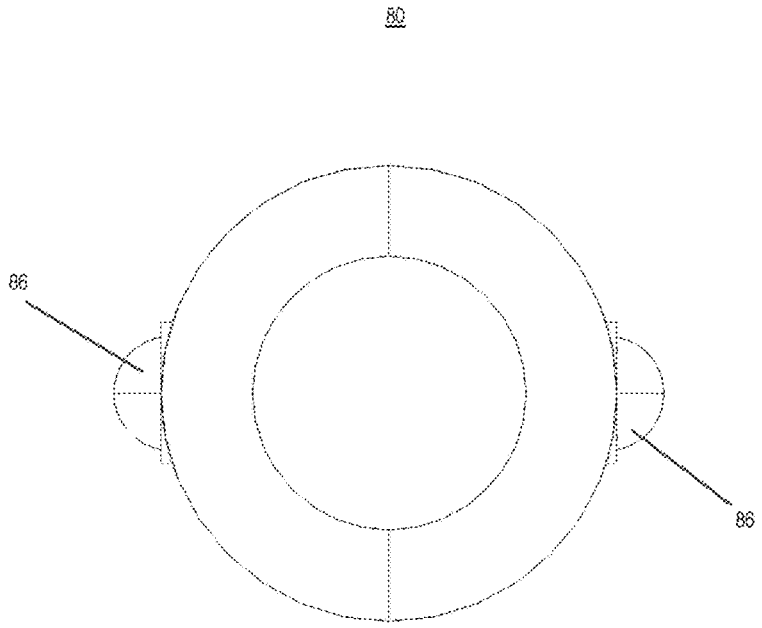
FIG. 30 is a bottom plan view of the peg.
Figure 31:
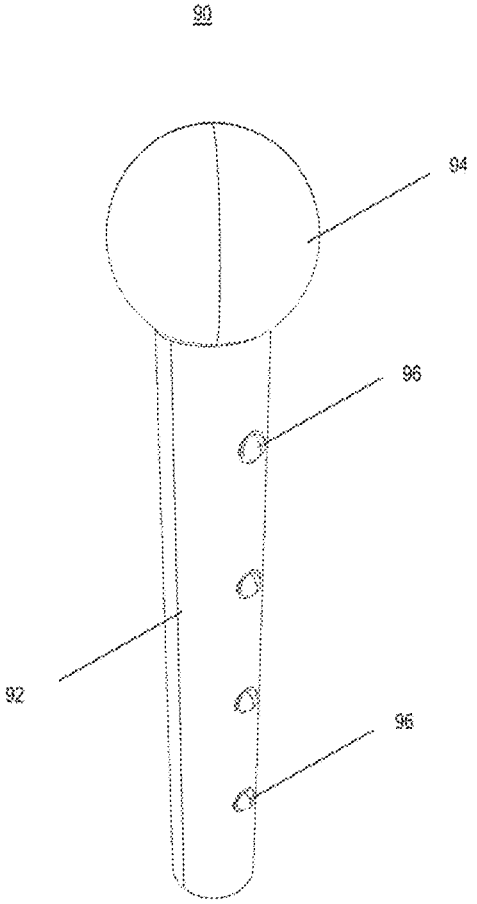
FIG. 31 is a perspective view of another peg having spring-loaded nubs in accordance with another embodiment of the present invention.
Figure 32:
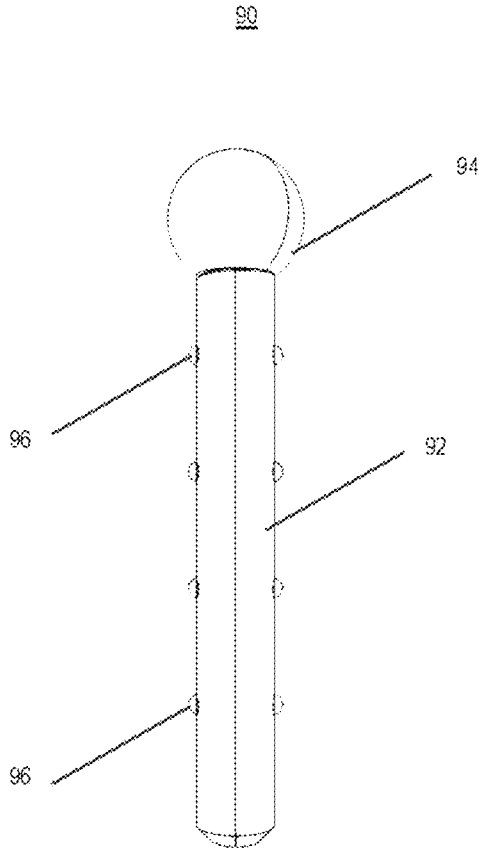
FIG. 32 is a front elevation view of the peg.
Figure 33:
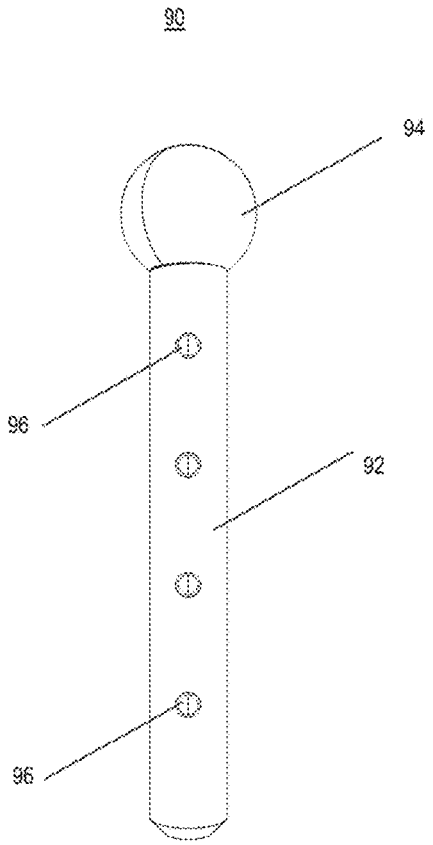
FIG. 33 is a side elevation view of the peg.
Figure 34:
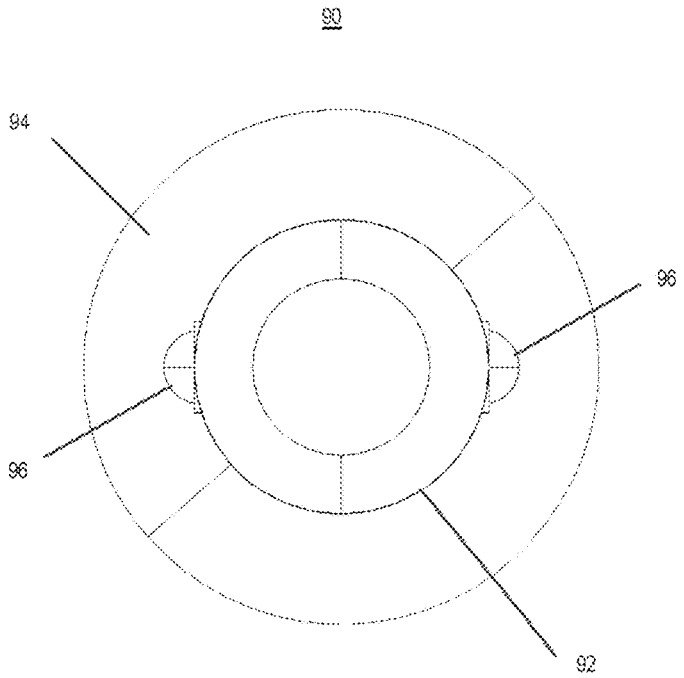
FIG. 34 is a bottom plan view of the peg.
Figure 35:
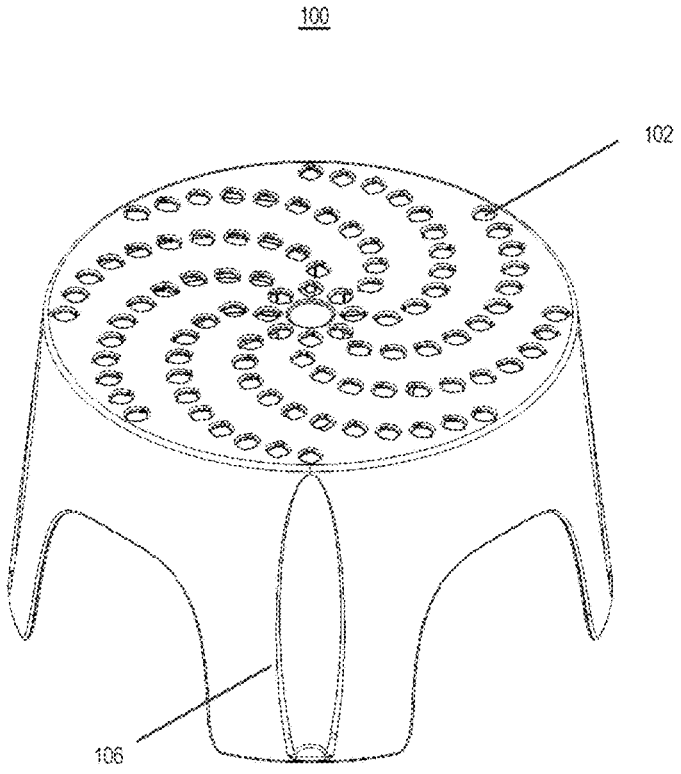
FIG. 35 is a perspective view of another platform in accordance with another embodiment of the present invention.
Figure 36:
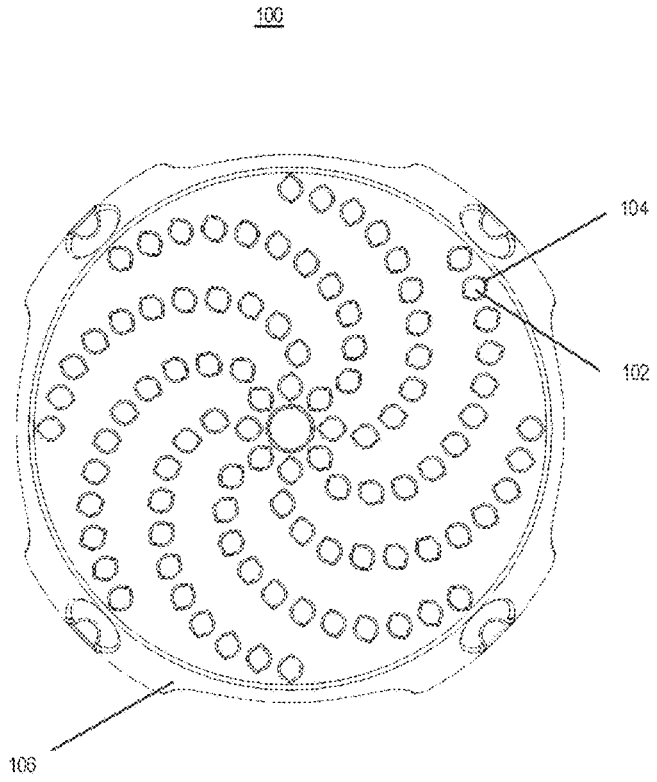
FIG. 36 is a top plan view of the platform.
Figure 37:
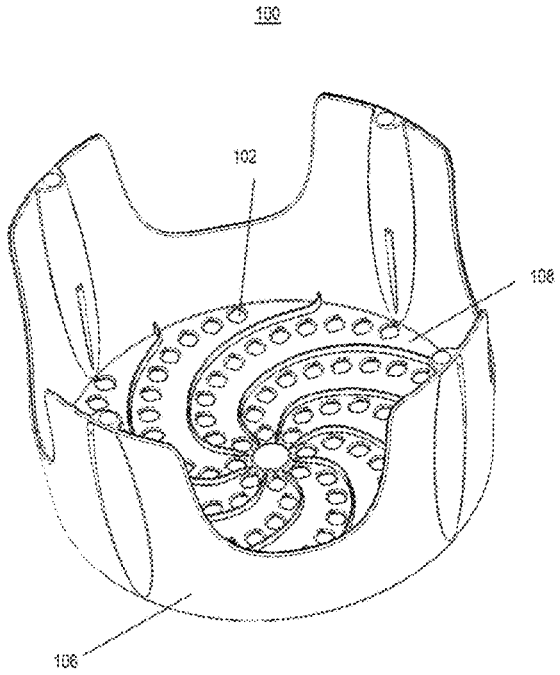
FIG. 37 is a bottom perspective view of the platform.
Figure 38:
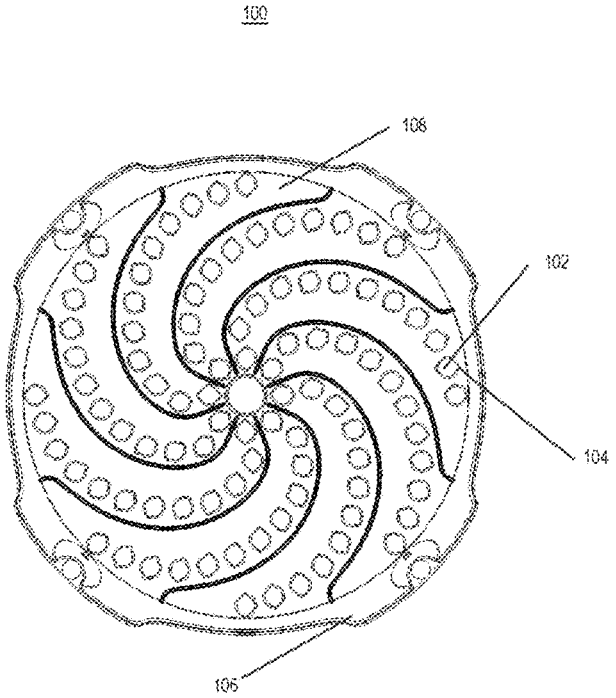
FIG. 38 is a bottom plan view of the platform.
Figure 39:
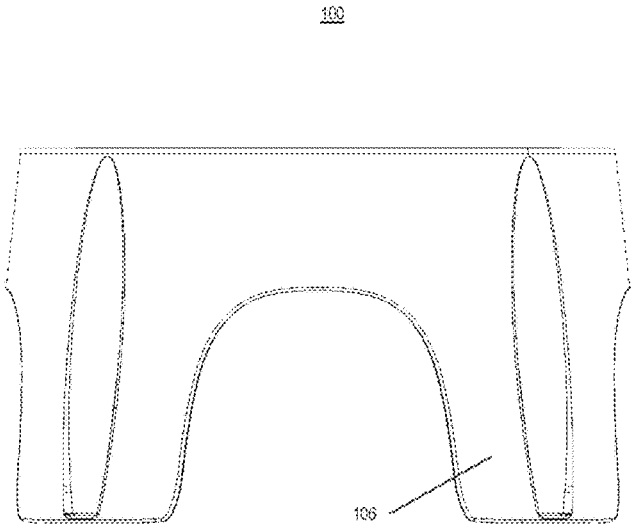
FIG. 39 is a side view of the platform.
Figure 40:
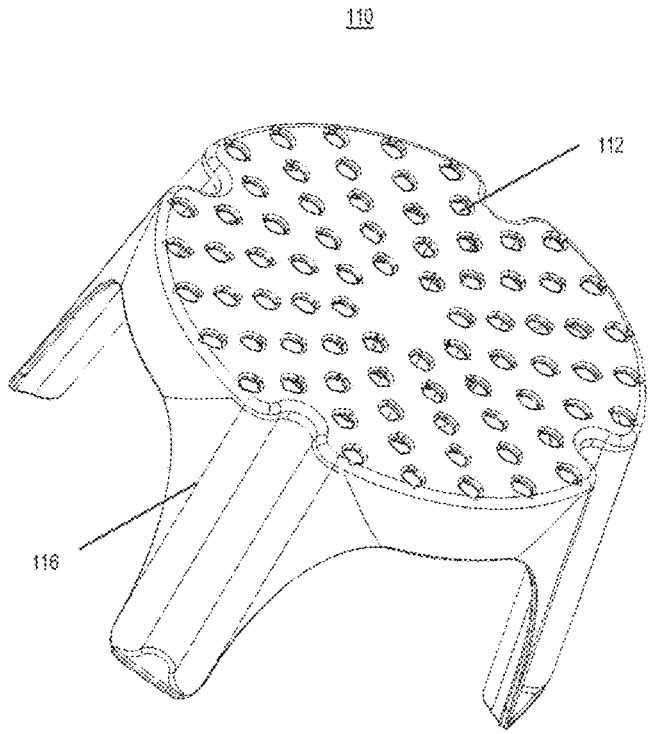
FIG. 40 is a perspective view of another platform in accordance with another embodiment of the present invention.
Figure 41:
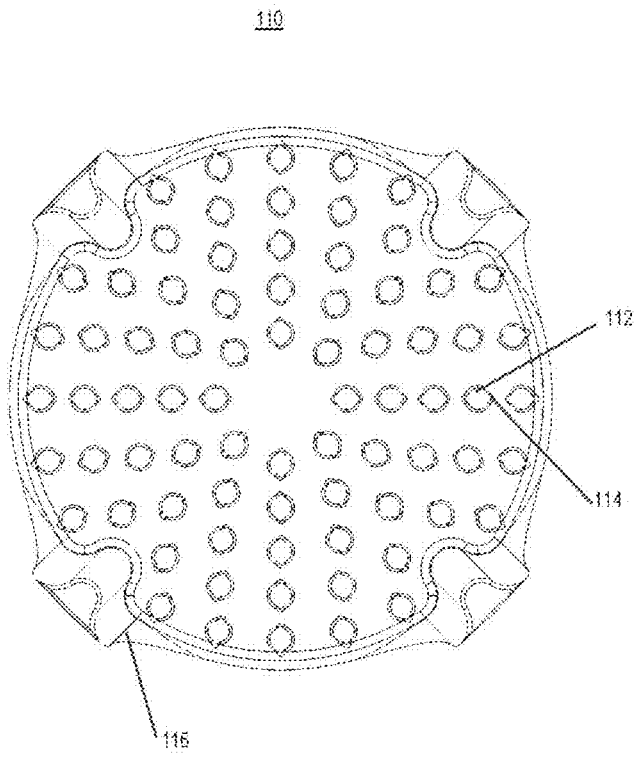
FIG. 41 is a top plan view of the platform.
Figure 42:
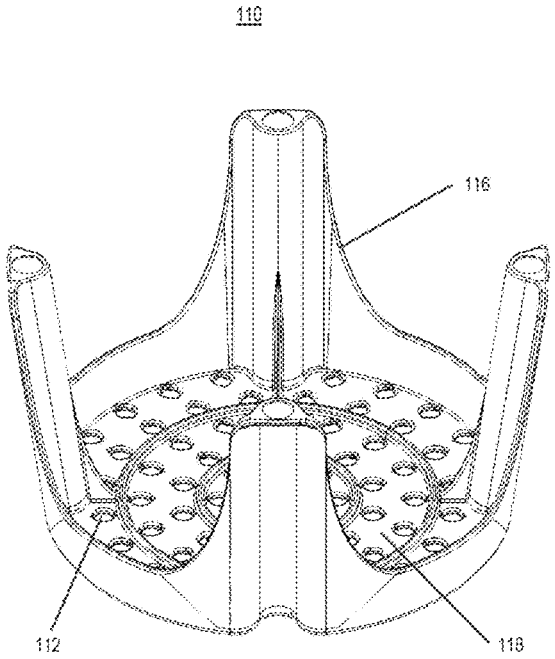
FIG. 42 is a bottom perspective view of the platform.
Figure 43:
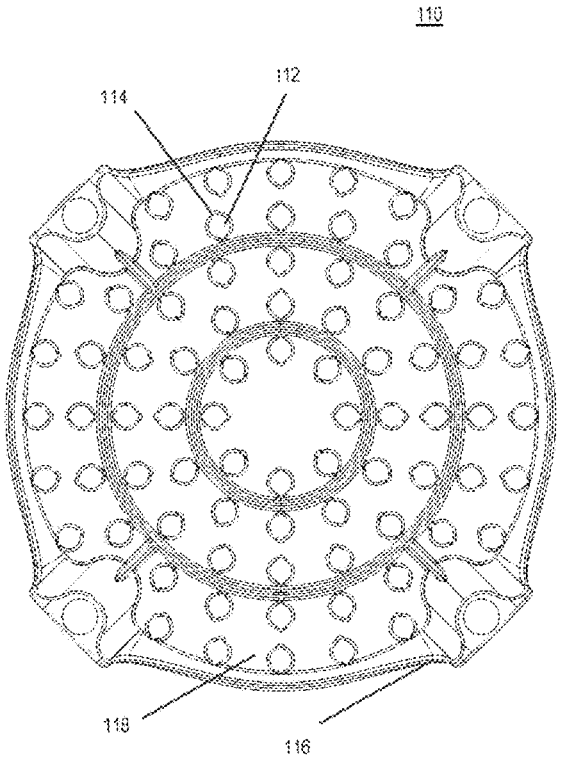
FIG. 43 is a bottom plan view of the platform.
Figure 44:
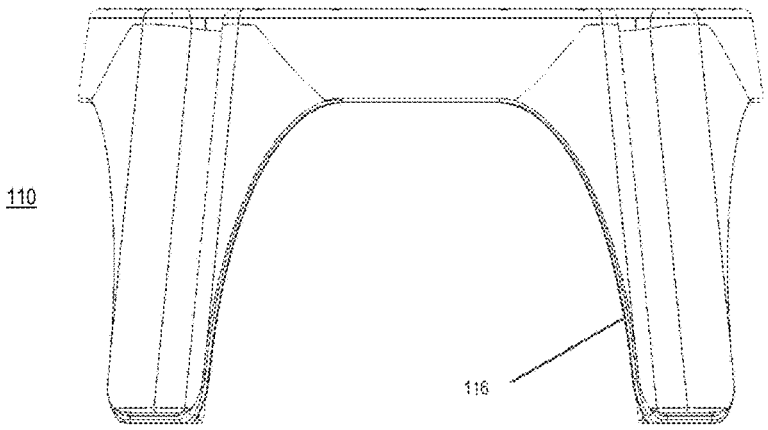
FIG. 44 is a side view of the platform.
Figure 45:
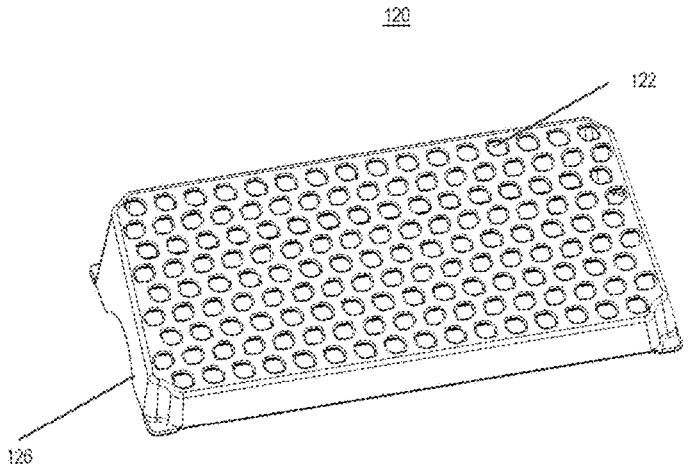
FIG. 45 is a perspective view of another platform in accordance with another embodiment of the present invention.
Figure 46:
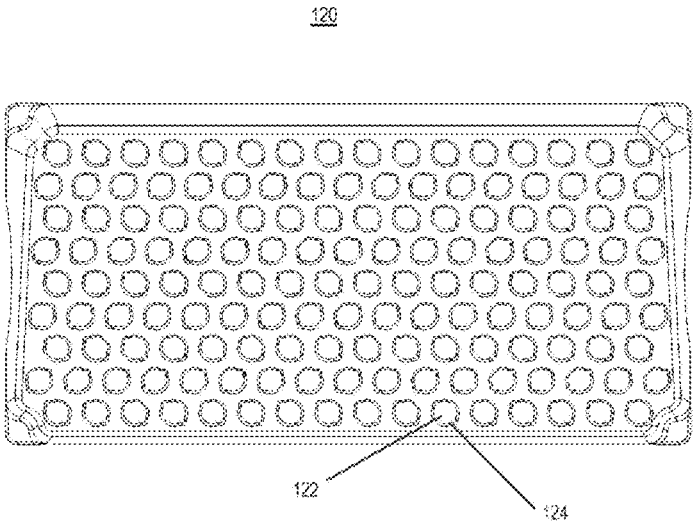
FIG. 46 is a top plan view of the platform.
Figure 47:
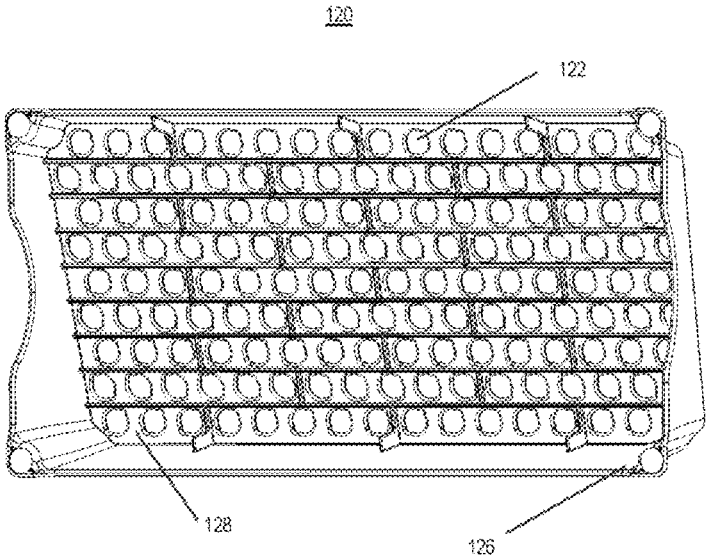
FIG. 47 is a bottom perspective view of the platform.
Figure 48:
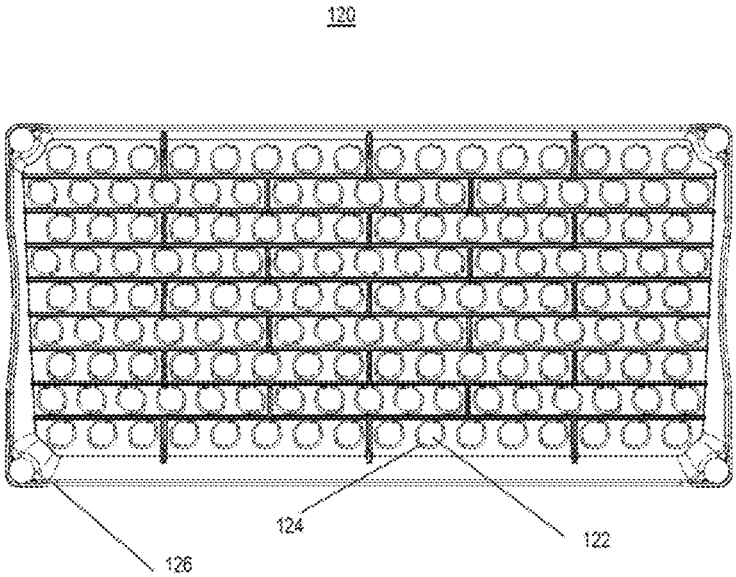
FIG. 48 is a bottom plan view of the platform.
Figure 52:
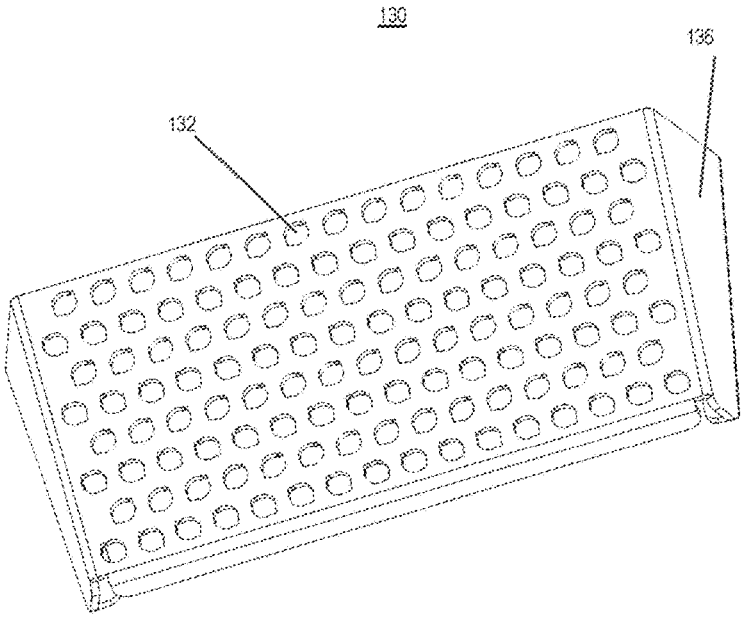
FIG. 52 is a perspective view of another platform in accordance with another embodiment of the present invention.
Figure 53:
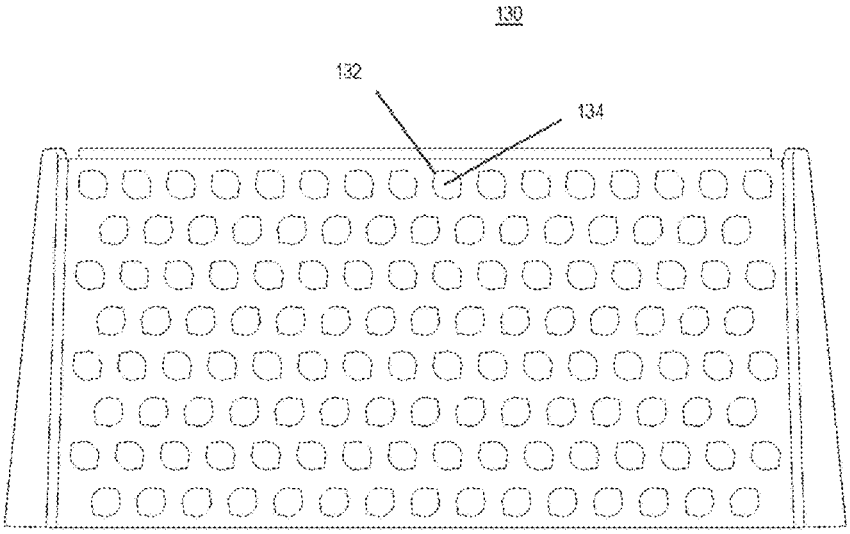
FIG. 53 is a top plan view of the platform.
Figure 54:
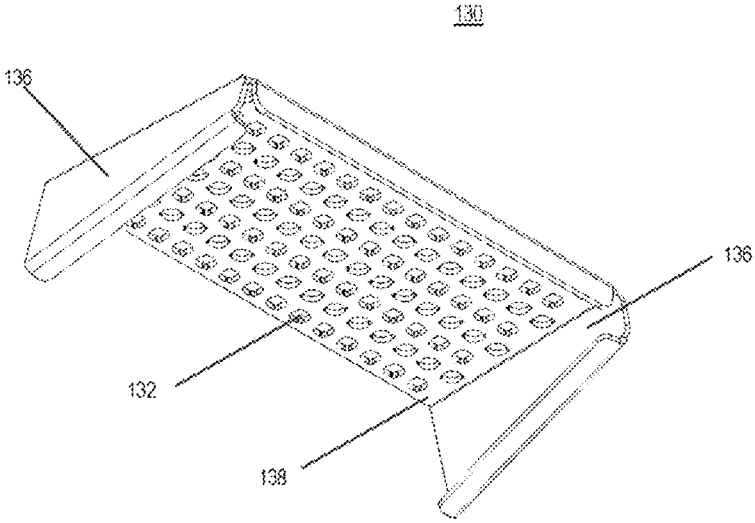
FIG. 54 is a bottom perspective view of the platform.
Figure 55:
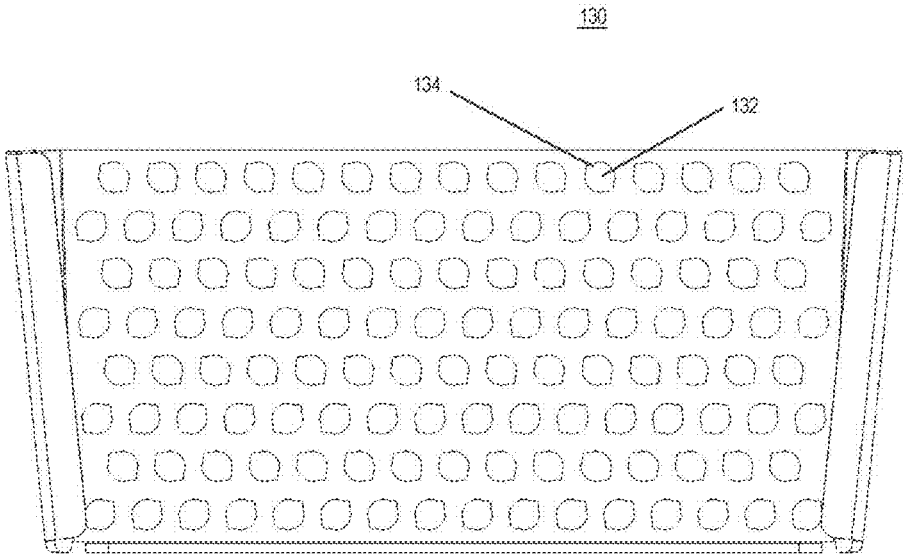
FIG. 55 is a bottom plan view of the platform.
Figure 56:
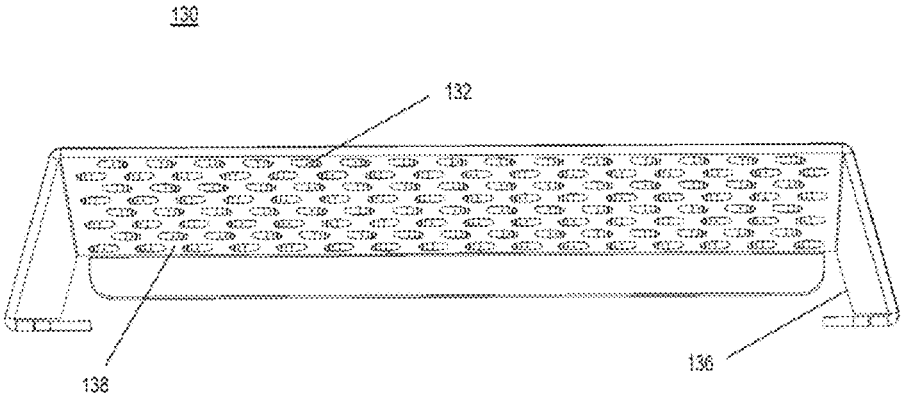
FIG. 56 is a front elevation view of the platform.
Figure 57:
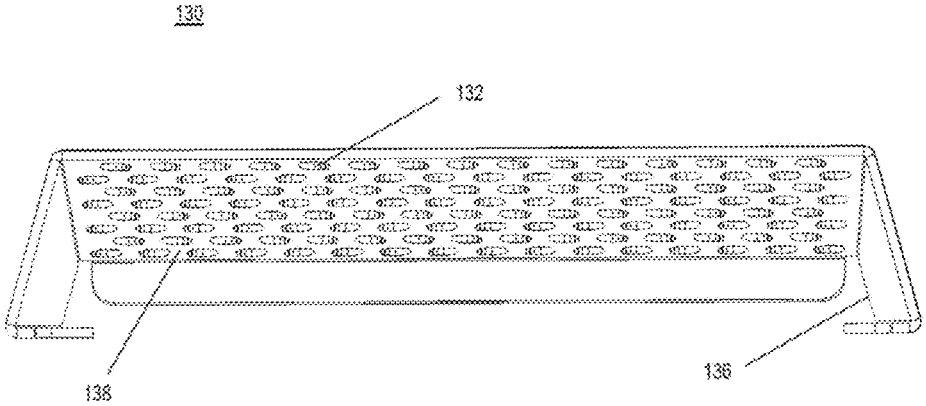
FIG. 57 is a rear elevation view of the platform.
Figure 58:
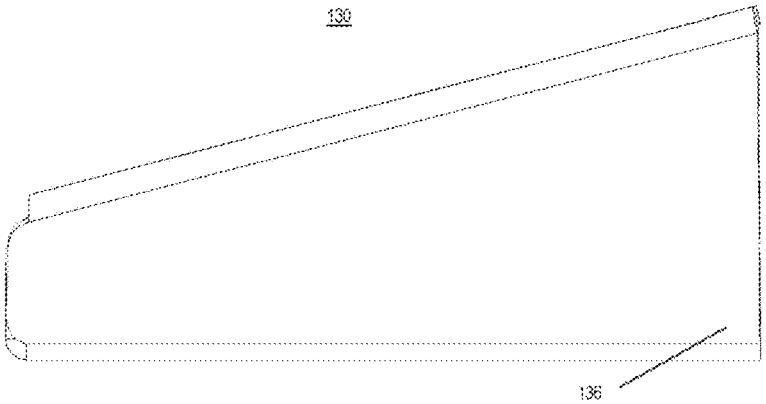
FIG. 58 is a side elevation view of the platform.
Figure 59:
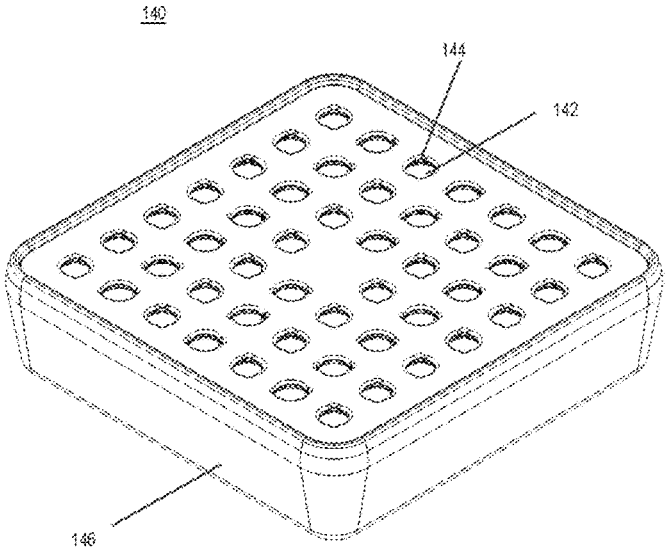
FIG. 59 is a perspective view of another platform in accordance with another embodiment of the present invention.
Figure 60:
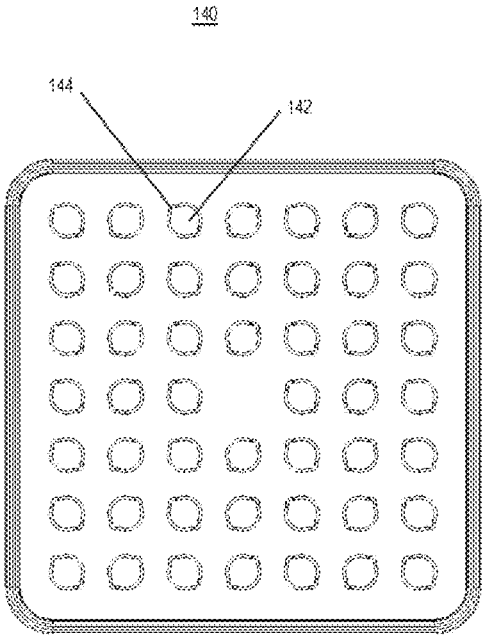
FIG. 60 is a top plan view of the platform.

As illustrated in FIGS. 19 through 22, another embodiment of the peg 60 includes a shaft 52 having two ends with an enlarged circular head 54 at the upper end. The peg 60 includes multiple pairs of different nubs including circular nubs 66 and trapezoidal nubs 68. The circular nubs 66 may be fixed. In the alternative, the circular nubs may be spring-loaded to be pushed into the shaft which can facilitate pushing the peg down through the platform openings. As shown in FIG. 22, the apex of the circular nubs 66 preferably creates the same height away from the surface of the shaft as the longer side of the trapezoidal nubs 68 from the surface of the shaft.

As illustrated in FIGS. 23 through 26, another embodiment of the peg 70 includes a shaft 72 having two ends having the same size with no enlarged head at either end. The peg 70 includes multiple pairs of nubs 76 along the length of the shaft 72. The top and bottom have a similar appearance, so the view of the peg 70 in FIG. 26 would look the same from the top as viewing from the bottom.

As illustrated in FIGS. 27 through 30, another embodiment of the peg 80 includes a shaft 82 having two ends having the same size with no enlarged head at either end. The peg 80 includes multiple pairs of circular nubs 86. The circular nubs may be fixed or spring-loaded to be pushed into the shaft 82 which can facilitate pushing the peg down through the platform openings. The top and bottom have a similar appearance, so the view of the peg 80 in FIG. 30 would look the same from the top as viewing from the bottom.

As illustrated in FIGS. 31 through 34, another embodiment of the peg 90 includes a shaft 92 having two ends with an enlarged head 94 at the upper end. The peg 90 includes multiple pairs of circular nubs 96. The circular nubs may be fixed or spring-loaded to be pushed into the shaft 82 which can facilitate pushing the peg down through the platform openings.

As illustrated in FIGS. 35 through 39, another embodiment of a circular platform 100 for accepting the peg includes keyed openings or slots 102 configured with notches 104 or other keyed shapes complementary to the nubs of the previously discussed embodiments of the peg. The openings or slots 102 are positioned to form a spiral pattern on the platform 100. The legs formed by the sidewalls 106 of the platform 100 sets the openings or slots 102 to occupy a raised position. Preferably the area bounded by the area below the bottom surface 108 and the sidewalls 106 is hollow to allow the lower portion of the peg to move or pivot.

As illustrated in FIGS. 40 through 44, another embodiment of a circular platform 110 for accepting the peg includes keyed openings or slots 112 configured with notches 114 or other keyed shapes complementary to the nubs of the previously discussed embodiments of the peg. The openings or slots 112 are positioned to form a grid pattern on the platform 110. The legs formed by the sidewalls 116 of the platform 110 sets the openings or slots 112 to occupy a raised position. Preferably the area bounded by the area below the bottom surface 118 and the sidewalls 116 is hollow to allow the lower portion of the peg to move or pivot.

As illustrated in FIGS. 45 through 51, another embodiment of a slanted rectangular platform 120 for accepting the peg includes keyed openings or slots 122 configured with notches 124 or other keyed shapes complementary to the nubs of the previously discussed embodiments of the peg. The openings or slots 122 are positioned to form a grid pattern on the platform 120. The sidewalls 126 of the platform 120 sets the openings or slots 122 to occupy a raised position. Preferably the area bounded by the area below the bottom surface 128 and the sidewalls 126 is hollow to allow the lower portion of the peg to move or pivot.

As illustrated in FIGS. 52 through 58, another embodiment of a slanted rectangular platform 130 for accepting the peg includes keyed openings or slots 132 configured with notches 134 or other keyed shapes complementary to the nubs of the previously discussed embodiments of the peg. The openings or slots 132 are positioned to form a grid pattern on the platform 130. The sidewalls 136 of the platform 130 sets the openings or slots 132 to occupy a raised position. Preferably the area bounded by the area below the bottom surface 138 and the sidewalls 136 is hollow to allow the lower portion of the peg to move or pivot.

Figure 61:
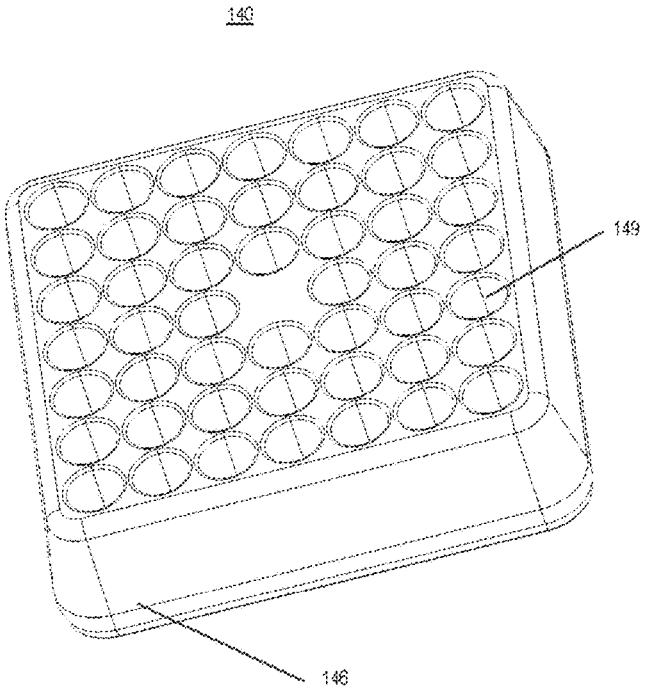
FIG. 61 is a bottom perspective view of the platform.
Figure 62:
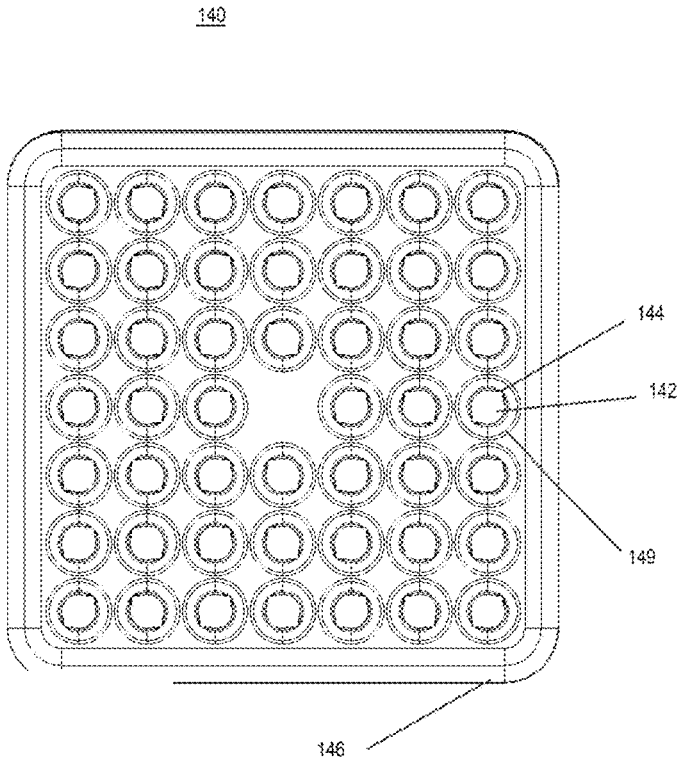
FIG. 62 is a bottom plan view of the platform.
Figure 63:
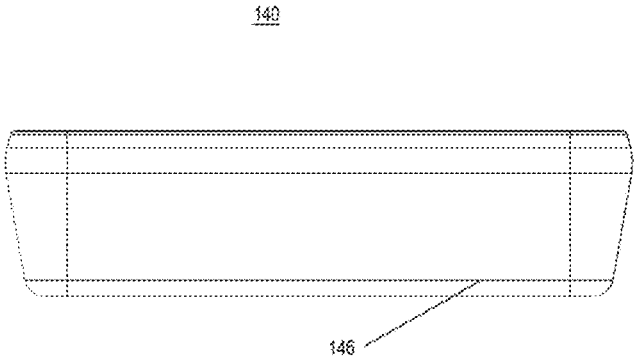
FIG. 63 is a side elevation view of the platform.

As illustrated in FIGS. 59 through 63, another embodiment of a squircle-shaped platform 140 for accepting the peg includes keyed openings or slots 142 configured with notches 144 or other keyed shapes complementary to the nubs of the previously discussed embodiments of the peg. The openings or slots 142 are positioned to form a grid pattern on the platform 140. The sidewalls 146 of the platform 140 sets the openings or slots 142 to occupy a raised position. As shown in FIGS. 61 and 62, the area beneath each of the openings or slots 142 is bounded by a hollow cylinder 149 to allow the lower portion of the peg to move or pivot.

Figure 64:
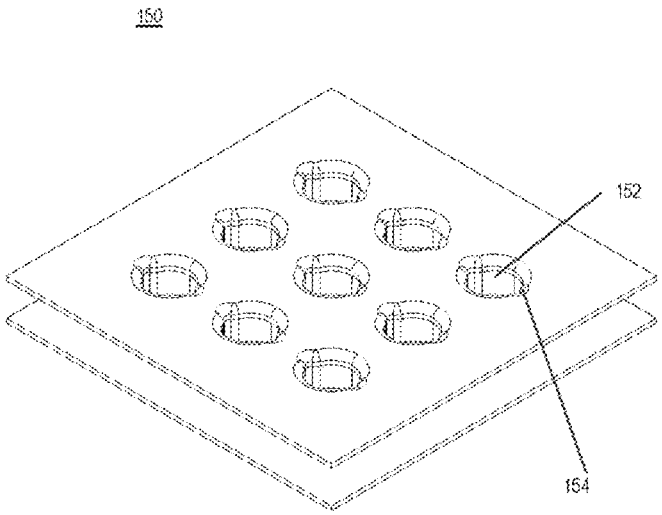
FIG. 64 is a perspective view of another platform in accordance with another embodiment of the present invention.
Figure 65:
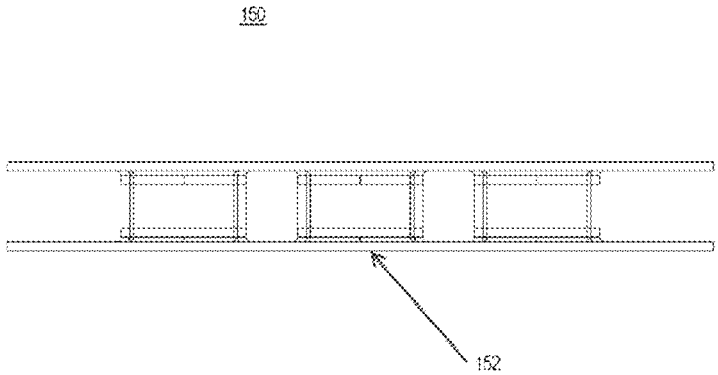
FIG. 65 is a side elevation view of the platform.
Figure 66:
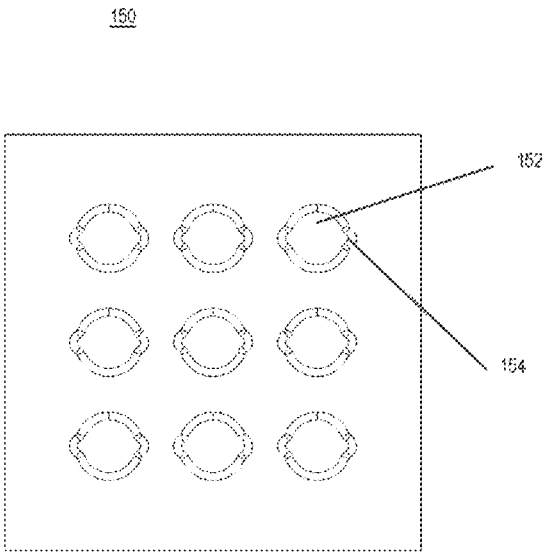
FIG. 66 is a top plan view of the platform.

As illustrated in FIGS. 64 through 66, another embodiment of a square-shaped platform 150 for accepting the peg includes keyed openings or slots 152 configured with notches 154 or other keyed shapes complementary to the nubs of the previously discussed embodiments of the peg. The openings or slots 152 form a Einstein-Rosen wormhole shape between the top and bottom planes of the platform 150. The openings or slots 152 are positioned on the platform 150 to form a grid pattern. The top and bottom have a similar appearance, so the view of the platform 150 in FIG. 66 would look the same from the top as viewing from the bottom.

Figure 67:
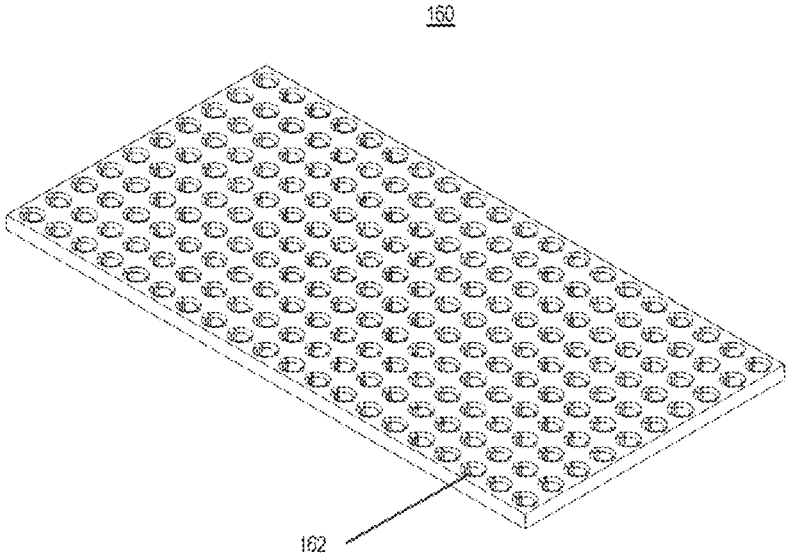
FIG. 67 is a perspective view of another platform in accordance with another embodiment of the present invention.
Figure 68:
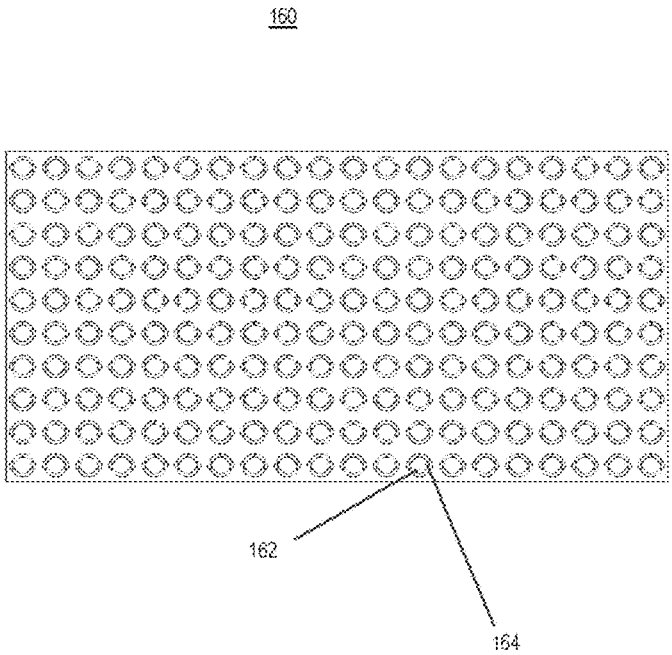
FIG. 68 is a top plan view of the platform.
Figure 69:
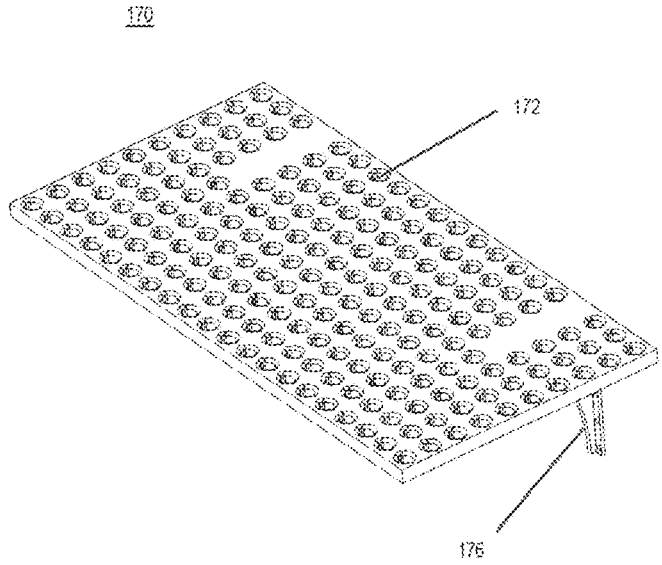
FIG. 69 is a perspective view of a shelf platform in accordance with another embodiment of the present invention.
Figure 70:
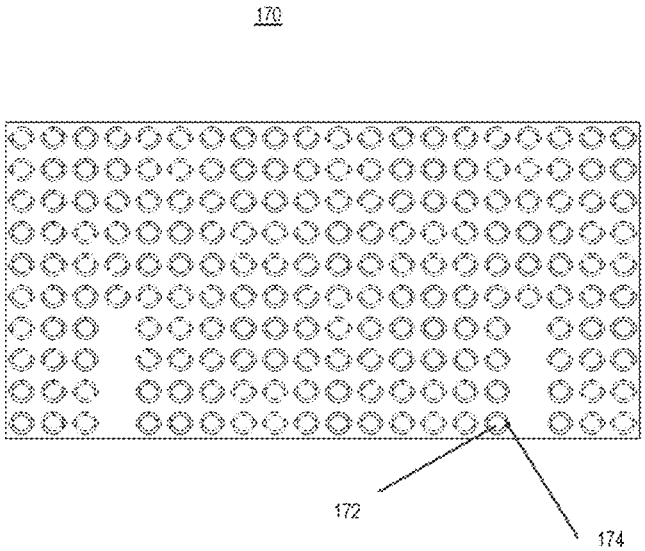
FIG. 70 is a top plan view of the platform.
Figure 71:
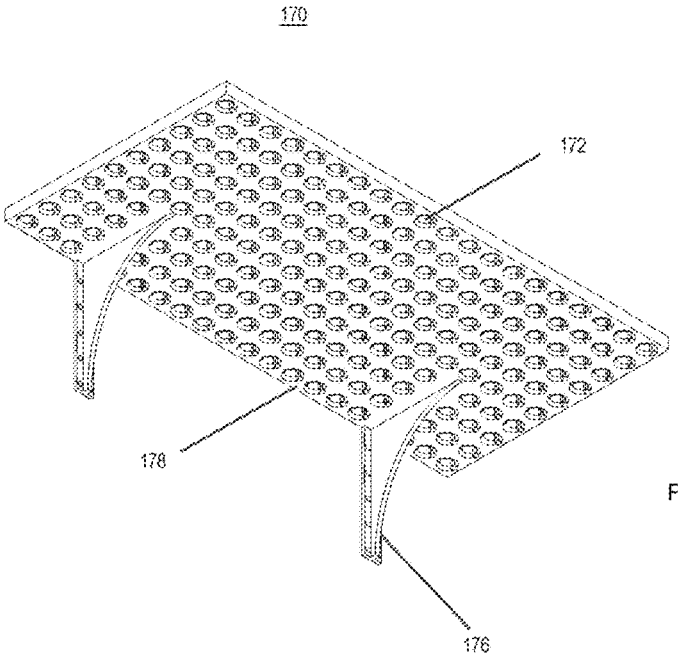
FIG. 71 is a bottom perspective view of the platform.
Figure 76:
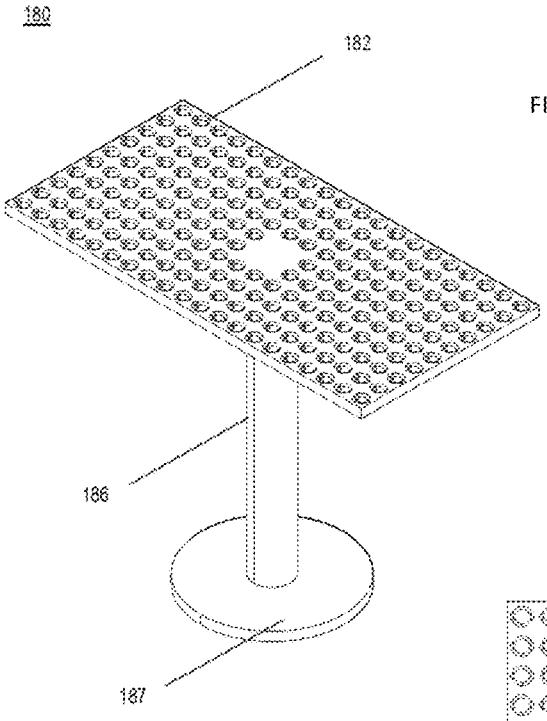
FIG. 76 is a perspective view of a table platform in accordance with another embodiment of the present invention.
Figure 77:
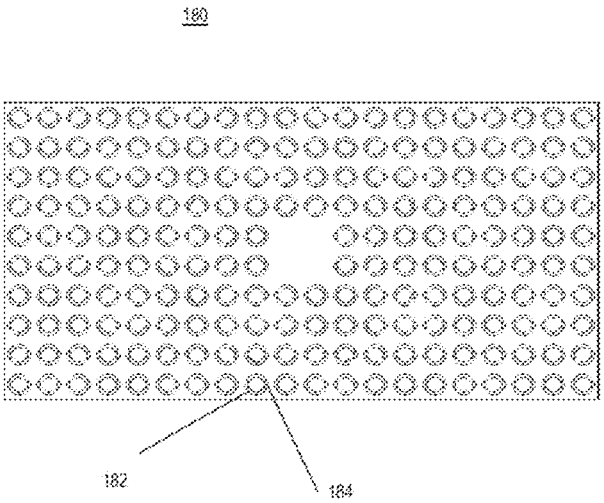
FIG. 77 is a top plan view of the platform.
Figure 78:
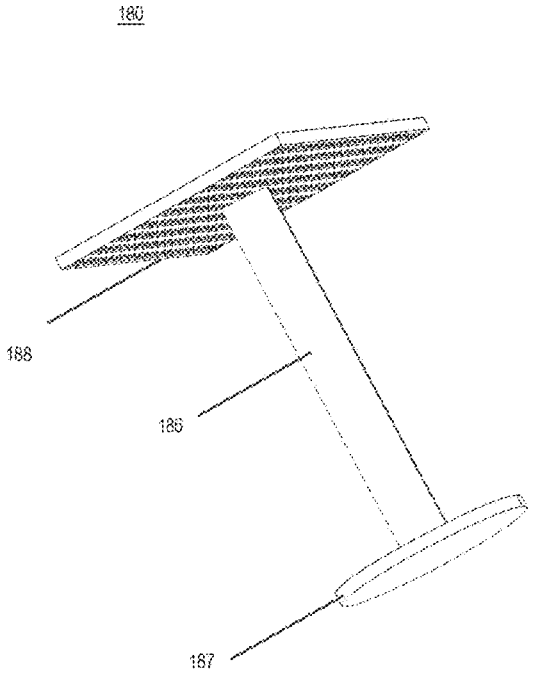
FIG. 78 is a bottom perspective view of the platform.
Figure 79:
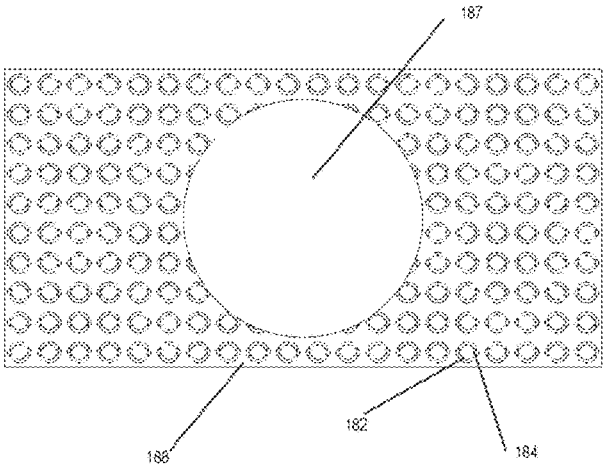
FIG. 79 is a bottom plan view of the platform.

As illustrated in FIGS. 67 through 68, another embodiment of a rectangular platform plate 160 for accepting the peg includes keyed openings or slots 162 configured with notches 164 or other keyed shapes complementary to the nubs of the previously discussed embodiments of the peg. The openings or slots 162 are positioned on the platform 160 to form a grid pattern. The top and bottom have a similar appearance, so the view of the platform 160 in FIG. 68 would look the same from the top as viewing from the bottom. The platform plate 160 may be used to form other structures.

As illustrated in FIGS. 69 through 75, another embodiment of a rectangular shelf platform 170 for accepting the peg includes keyed openings or slots 172 configured with notches 174 or other keyed shapes complementary to the nubs of the previously discussed embodiments of the peg. The openings or slots 172 are positioned on the platform 170 to form a grid pattern. Brackets 176 are placed on the bottom 178 of the platform 170.

As illustrated in FIGS. 76 through 79, another embodiment of a rectangular table platform 180 for accepting the peg includes keyed openings or slots 182 configured with notches 184 or other keyed shapes complementary to the nubs of the previously discussed embodiments of the peg. The openings or slots 182 are positioned on the platform 180 to form a grid pattern. The table top portion of the platform 180 is supported by a pillar 186 and base 187.

Figure 80:
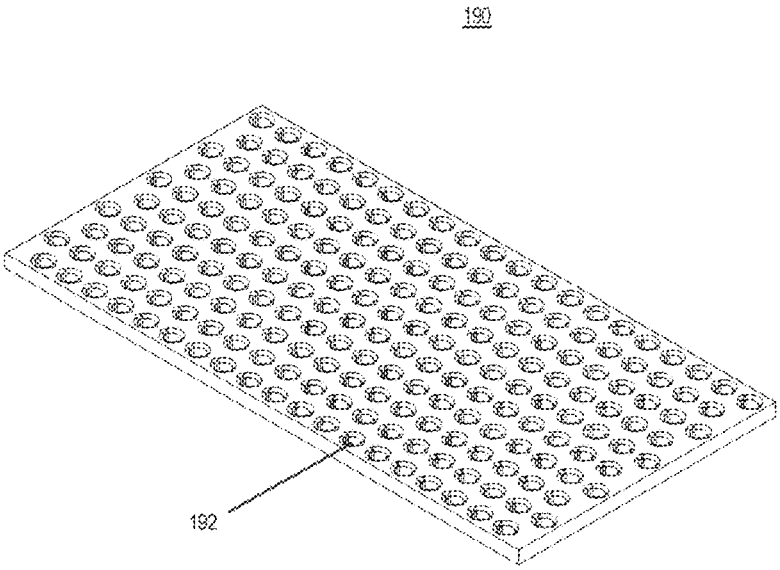
FIG. 80 is a perspective view of a platform in accordance with another embodiment of the present invention.
Figure 81:
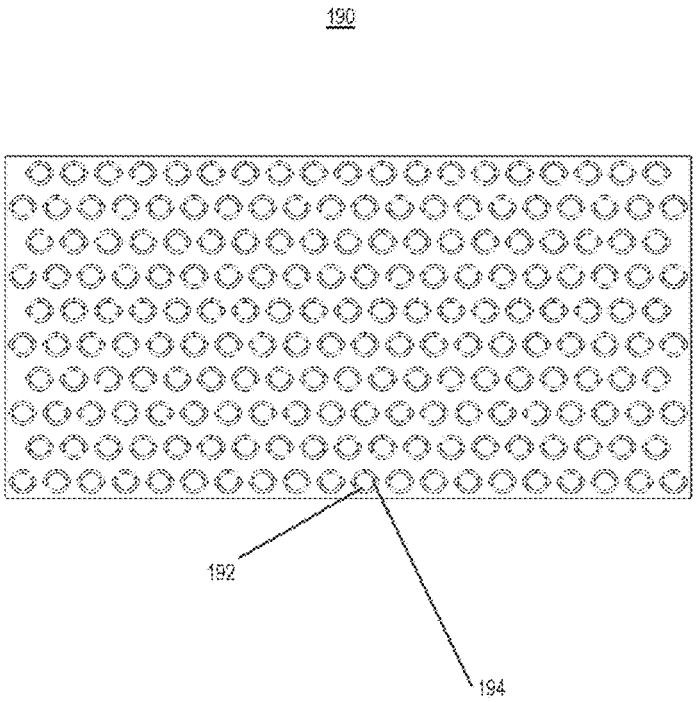
FIG. 81 is a top plan view of the platform.

As illustrated in FIGS. 80 through 81, another embodiment of a rectangular platform plate 190 for accepting the peg includes keyed openings or slots 192 configured with notches 194 or other keyed shapes complementary to the nubs of the previously discussed embodiments of the peg. The openings or slots 192 are positioned on the platform 190 to form an offset grid pattern. The top and bottom have a similar appearance, so the view of the platform 190 in FIGS. 81 would look the same from the top as viewing from the bottom. The platform plate 190 may be used to form other structures.

In general, the height of the peg elements may be adjustable when engaged at the location or slot. The cross-sectional shape of the peg element may have protrusions along the length of the peg that will pass through the slot when in one orientation, and inhibit movement when rotated to have a different orientation. In different embodiments, depending on the orientation of the peg element after passing through the slot, the pegs may protrude from the top of the surface at different heights. The height of the protruding peg may be adjusted by the desired amount necessary to provide sufficient grip or securing force to immobilize the object on the surface. The shape of the protruding portion, may vary based on engineering or manufacturing considerations, with one embodiment including a spherical or bulbous shape formed at the protruding upper or distal end of the peg.

The object to be immobilized may be placed on the top of a platform surface and the one or more peg element may be inserted in select slots in or around the object to thereby immobilize and secure the object on the platform in a customizable or adjustable manner. The pegs may define a confine or boundary around the periphery of the object to hold or immobilize the object set on the platform.

In some embodiments the slots may be arranged in a predetermined shape or pattern. One pattern is a spiral pattern. In other embodiments the slots may be randomly placed. In yet another embodiment, the slots may be formed as openings or receptacles formed into the surface.

Depending on whether the top surface has sufficient depth, the slots could be countersunk to accommodate the upper head of the peg element. All of the slots could be occupied by a peg element, whether captive or separable. And the desired number of pegs may be lifted above the surface to immobilize a vessel, container, or other object, in place or on the surface.

Further, the cross-sectional shape of the peg element may have protrusions along the length of the peg where each set of protrusions at a certain length of the peg are oriented or offset from other sets of protrusions at another certain length of the peg so that the peg would have to be rotated in order to again complement the shape of the slot and travel further down the slot to achieve a different height for the peg from the surface.

Although embodiments of the invention are described, it is understood that not every embodiment of the invention is shown and described herein. Unless specifically noted, the words and phrases in the specification and claims are intended to be given the ordinary and accustomed meanings to those of ordinary skill in the applicable art.

What is claimed:

1. An apparatus comprising:

a platform having a top, a bottom, and a plurality of openings from the top through the bottom;

a plurality of pegs, wherein each peg includes a first end, a second end, a shaft having a length between the first end and the second end, the shaft being unforked and nubs protruding from the shaft of each peg;

wherein each of the openings are shaped to allow the first end of the shaft to pass therethrough but not the pair of nubs unless the peg is positioned so that the nubs are aligned with a specific portion of the opening configured to allow a nub to pass through, and when the nubs do not pass through the opening, the nubs act as a pivot axis where a portion of the peg remains above the platform such that the portions of the pegs above the platform define a confine for immobilizing an object on the platform; wherein at least one of the pegs includes at least a first pair of nubs closer to the first end of the peg, and a second pair of nubs closer to the second end of the peg, the first pair of nubs having a first trapezoidal shape where the shorter side faces the first end, and the second pair of nubs having a second trapezoidal shape where the shorter side faces the second end of the peg.

2. The apparatus of claim 1, wherein at least a pair of nubs have a trapezoidal shape where the longer side faces the first end of the peg, and the shorter side faces the second end of the peg.

3. The apparatus of claim 1, wherein the pegs include at least two pairs of nubs along the length of the shaft.

4. The apparatus of claim 1, wherein for each pair of nubs, the nubs are located on opposite sides of the shaft, and a head at the second end stops further movement of the peg through the opening.

5. The apparatus of claim 1, wherein at least one peg has a head at the second end of the at least one peg and the head is sized to prevent further passage of the at least one peg through at least one of the plurality of openings.

6. The apparatus of claim 1, wherein, when the nubs do not pass through the opening, the nubs have contact points with the top of the platform to allow the portion of the peg remaining above the platform to be subject to angular movement.

7. A peg apparatus comprising a first end, a second end, and a shaft having a length between the first end and the second end, and nubs protruding from the shaft, wherein the nubs include at least one pair of nubs has a longer side and a shorter side, such that the longer side faces the first end of the peg, and the shorter side faces the second end of the peg; further comprising at least a first pair of nubs closer to the first end of the peg, and a second pair of nubs closer to the second end of the peg, the first pair of nubs having a first trapezoidal shape where the shorter side faces the first end, and the second pair of nubs having a second trapezoidal shape where the shorter side faces the second end of the peg.

8. The peg apparatus of claim 7, wherein the nubs includes at least two pairs of nubs offset from one another along the length of the shaft, and a head at the second end sized to have a circumference larger than the circumference of the shaft.

9. The peg apparatus of claim 7, wherein for each pair of nubs, the nubs are located 180 degrees apart on opposite sides of the shaft.

10. The peg apparatus of claim 7, wherein the nubs are spring-loaded to extend away from the shaft.

11. The peg apparatus of claim 7, further comprising circular nubs.

12. A method of immobilizing an object on a platform, comprising the steps of:

placing a plurality of pegs in a platform having a top, a bottom, and a plurality of openings from the top through the bottom, wherein each peg includes a first end, a second end, and a shaft having a length between the first end and the second end, and nubs protruding from the shaft of each peg, such each of the openings are shaped to allow the first end of the shaft to pass therethrough but not the pair of nubs unless the peg is positioned so that the nubs are aligned with a portion of the opening; and when the nubs do not pass through the opening, the nubs act as a pivot axis where a portion of the peg remains above the platform; wherein at least one of the pegs includes at least a first pair of nubs closer to the first end of the peg, and a second pair of nubs closer to the second end of the peg, the first pair of nubs having a first trapezoidal shape where the shorter side faces the first end, and the second pair of nubs having a second trapezoidal shape where the shorter side faces the second end of the peg;

positioning each of the pegs of the plurality of pegs in an opening where so that the nub of at least one of the pegs does not pass through the opening where a portion of the peg remains above the platform such that the portions of the pegs above the platform define a confine for immobilizing an object on the platform;

setting an object on the top of the platform wherein the object is immobilized by the plurality of pegs placed in the platform.

13. The method of claim 12, wherein the nubs include at least one pair of nubs having has a trapezoidal shape where the longer side faces the first end of the peg, and the shorter side faces the second end of the peg.

14. The method of claim 12, wherein for each pair of nubs, the nubs are located on opposite sides of the shaft to provide two degrees of mechanical freedom for the portion of the peg remaining above the platform.

15. The method of claim 12, wherein at least one peg has a head at the second end of the at least one peg and the head is sized to prevent further passage of the at least one peg through at least one of the plurality of openings.

16. The method of claim 12, wherein each pair of nubs is configured to engage the perimeter of the opening while allowing translational freedom of movement for pivoting the portion of the peg remaining above the platform.

* * * * *